US009893455B1

(12) United States Patent
Brodsky et al.

(10) Patent No.: US 9,893,455 B1
(45) Date of Patent: Feb. 13, 2018

(54) ELECTRICAL ARC PROTECTION USING A TRIP CONTACT

(71) Applicant: International Business Machines Corporation, Armonk, NY (US)

(72) Inventors: William L. Brodsky, Binghamton, NY (US); Byron S. Green, Poughkeepsie, NY (US); Robert K. Mullady, Highland, NY (US); Jeffrey A. Newcomer, Poughkeepsie, NY (US); Arkadiy O. Tsfasman, Wappingers Falls, NY (US); John S. Werner, Putnam Valley, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/340,006

(22) Filed: Nov. 1, 2016

(51) Int. Cl.

| | |
|---|---|
| ***H01R 29/00*** | (2006.01) |
| ***H01R 13/44*** | (2006.01) |
| ***H01R 13/703*** | (2006.01) |
| ***H01R 13/71*** | (2006.01) |

(52) U.S. Cl.
CPC ..... *H01R 13/44* (2013.01); *H01R 13/703* (2013.01); *H01R 13/71* (2013.01)

(58) Field of Classification Search
CPC ..... H01R 13/44; H01R 13/703; H01R 13/71; H01R 31/08; H01R 29/00; H01R 13/7032; H01R 31/085; H01R 25/006
USPC ..... 439/188, 181, 507
See application file for complete search history.

(56) References Cited

U.S. PATENT DOCUMENTS

| | | | |
|---|---|---|---|
| 2,922,054 | A | 1/1960 | Miller |
| 3,453,403 | A | 7/1969 | Hoffman |
| 3,477,001 | A | 11/1969 | Haas et al. |
| 4,283,100 | A | 8/1981 | Griffin et al. |

(Continued)

FOREIGN PATENT DOCUMENTS

| | | | |
|---|---|---|---|
| CN | 103956619 | A | 7/2014 |
| CN | 205029123 | U | 2/2016 |

(Continued)

OTHER PUBLICATIONS

Brodsky, et al, "Electrical Arc Protection Using a Trip Jumper", U.S. Appl. No. 15/340,021, filed Nov. 1, 2016.

(Continued)

*Primary Examiner* — Xuong Chung Trans
(74) *Attorney, Agent, or Firm* — Michael Purdham

(57) ABSTRACT

A plug comprises power contacts and a plug trip contact. During a plugging action between the plug and a receptacle, the plug trip contact makes a trip connection with mating contacts in the receptacle. Electrical power to the receptacle allows a current through the trip connection, which causes disconnection of the power to the receptacle. A receptacle comprises receptacle power contacts and receptacle trip contacts. During a plugging action between the receptacle and a plug, trip contacts in the receptacle makes a trip connection with a mating contact in the plug. Electrical power to the receptacle allows a current through the trip connection, which can cause disconnection of the power to the receptacle. The receptacle can be included in an enclosure having a trip breaker with a trip mechanism. An electrical system can have an electrical device with a line cord connected to a plug having the trip contact.

19 Claims, 16 Drawing Sheets

(56) References Cited

U.S. PATENT DOCUMENTS

| | | | | |
|---|---|---|---|---|
| 4,331,998 | A | 5/1982 | Matsko et al. | |
| 4,345,122 | A | 8/1982 | Janniello | |
| 4,346,419 | A | 8/1982 | Janniello | |
| 4,429,935 | A | 2/1984 | Lamb et al. | |
| 4,604,505 | A | 8/1986 | Henninger | |
| 4,748,355 | A | 5/1988 | Anderson et al. | |
| 4,907,985 | A | 3/1990 | Johnsen | |
| 4,937,482 | A | 6/1990 | Dohogne | |
| 5,017,818 | A | 5/1991 | Dohogne | |
| 5,185,705 | A | 2/1993 | Farrington | |
| 5,249,976 | A | 10/1993 | Brock | |
| 5,298,701 | A | 3/1994 | Sandor | |
| 5,476,392 | A * | 12/1995 | Inaba | B60L 3/00 439/341 |
| 5,602,427 | A | 2/1997 | Dimitriev | |
| 5,711,681 | A | 1/1998 | Hasegawa | |
| 5,818,671 | A | 10/1998 | Seymour et al. | |
| 5,835,567 | A | 11/1998 | Woods | |
| 6,341,967 | B1 | 1/2002 | Nabeshima et al. | |
| 6,406,328 | B1 | 6/2002 | Attarian et al. | |
| 6,619,970 | B2 | 9/2003 | Fukushima et al. | |
| 6,746,275 | B2 * | 6/2004 | Yamakawa | H01R 13/701 439/507 |
| 6,793,510 | B2 | 9/2004 | Yamakawa et al. | |
| 7,001,196 | B1 | 2/2006 | Huang | |
| 7,066,749 | B2 | 6/2006 | Borrego Bel et al. | |
| 7,134,919 | B2 | 11/2006 | Putz | |
| 7,422,491 | B2 | 9/2008 | Gherardini | |
| 7,431,601 | B2 | 10/2008 | Nugent, Jr. et al. | |
| 7,817,055 | B1 | 10/2010 | Scanlon | |
| 7,955,102 | B2 | 6/2011 | Santos | |
| 8,193,445 | B2 | 6/2012 | Li | |
| 8,379,375 | B2 * | 2/2013 | Furuya | B60L 3/0069 200/17 R |
| 8,382,505 | B2 | 2/2013 | Park | |
| 8,460,027 | B2 | 6/2013 | Topolewski | |
| 8,616,915 | B2 | 12/2013 | Funamura | |
| 9,085,240 | B2 * | 7/2015 | Rathmacher | B60L 3/04 |
| 9,260,080 | B2 * | 2/2016 | Maguire | B60R 25/40 |
| 2002/0079993 | A1 | 6/2002 | Toepfer | |
| 2007/0097582 | A1 | 5/2007 | Shipp et al. | |
| 2013/0088798 | A1 * | 4/2013 | Ikeno | H01R 13/447 361/1 |
| 2013/0148249 | A1 | 6/2013 | Schlotterer et al. | |
| 2013/0301165 | A1 | 11/2013 | Ford et al. | |

FOREIGN PATENT DOCUMENTS

| | | | |
|---|---|---|---|
| CN | 205646236 | U | 10/2016 |
| CN | 104103978 | B | 1/2017 |
| EP | 367102 | A2 | 5/1990 |
| JP | 2013105563 | A | 5/2013 |

OTHER PUBLICATIONS

List of IBM Patents or Patent Applications Treated as Related, Oct. 28, 2016. 2 pages.

Tsfasman et al., "Electrical Arc Protection Using a Rotational Shield", IBM U.S. Appl. No. 15/643,686, filed Jul. 7, 2017.

List of IBM Patents or Patent Applications Treated as Related, Aug. 1, 2017. 2 pages.

* cited by examiner

ELECTRICAL ARC PROTECTION USING A TRIP CONTACT

BACKGROUND

The present disclosure relates to electrical power plugs and receptacles. More specifically, the present disclosure relates to protecting against electrical arc during connection of a plug to, and disconnection of a plug from, a receptacle.

SUMMARY

Embodiments of the present disclosure (hereinafter, "embodiments") can prevent an electrical arc between a plug and receptacle. In one embodiment a power plug comprises plug power contacts and a trip contact. During a plugging action to connect or disconnect the plug and a power receptacle, the plug trip contact makes a "trip connection" with two or more mating trip contacts in the receptacle. When, during the plugging action, one or more power contacts in the receptacle are connected to electrical power from a power source, the trip connection permits a "trip current" through the plug trip contact. The trip current can cause disconnection of a power contact in the receptacle, among those connected to the electrical power, from the electrical power.

In embodiments, the plug trip contact can be configured to break the trip connection when completing the plugging action, and when a trip current is present, breaking the trip connection can terminate the trip current. In some embodiments, connecting the plug and receptacle can make the trip connection prior to a power contact in the plug reaching a proximity to produce an electrical arc with any power contacts in the receptacle that are connected to electrical power. Alternatively, disconnecting the plug and receptacle can make the trip connection prior to power contacts in the plug breaking contact with mating power contacts in the receptacle.

The plug trip contact can have an electrically conductive region and an electrically non-conductive region. When connecting the plug and the receptacle, the plug trip contact electrically conductive region can make the trip connection with the receptacle trip contacts. The plug trip contact can be configured such that, when the plug and receptacle are fully connected, the plug trip contact electrically conductive region does not make a trip connection with the mating receptacle trip contacts and the plug trip contact electrically non-conductive regions is placed in contact with the respective mating receptacle trip contact to prevent a trip current through the plug trip contact.

In alternative embodiments, a power receptacle comprises receptacle power contacts and a trip circuit having two trip contacts. A plugging action to connect or disconnect the receptacle and a plug makes a trip connection between each of the two receptacle trip contacts and a trip contact in the plug. The trip connection permits a trip current through the two receptacle trip contacts when, during the plugging action, one or more power contacts in the receptacle is connected to electrical power from a power source. The trip current can cause disconnection of a receptacle power contact from the electrical power.

In such alternative embodiments, connecting the plug and receptacle can make the trip connection prior to a power contact in the plug reaching a proximity to produce an electrical arc with any power contacts in the receptacle that are connected to electrical power. Also in such alternative embodiments, disconnecting the plug and the receptacle can make the trip connection prior to power contacts in the receptacle breaking contact with mating power contacts in the plug.

In some embodiments of the receptacle, the receptacle can be included in an enclosure having a trip breaker connecting one or more of the receptacle power contacts to the electrical power. When the receptacle trip contacts make the trip connection with a mating trip contact in a plug, and the receptacle is receiving power from the power source, the trip breaker can respond to a current through the receptacle trip contacts and disconnect power contacts in the receptacle from the power source. Some embodiments of the trip breaker can include a trip mechanism configured to open the trip breaker in response to a current through the receptacle trip contacts.

Embodiments of the enclosure can further include an interlock mechanism having an open and closed position. The open position can open a connection between one or more of the power contacts in the receptacle and the electrical power. The closed position can close a connection between power contacts in the receptacle and the electrical power. In some embodiments, the interlock mechanism can open and close a connection between power contacts in the receptacle and a facility circuit breaker.

A system can include an electrical device having a line cord with a plug having a trip contact. The line cord can include electrical wires to connect the electrical device to the plug, and the plug can connect to a receptacle. A plugging action connecting or disconnecting the plug and receptacle can make a trip connection between the trip contact in the plug and two or more mating trip contacts in the receptacle. The trip connection can permit a trip current through the plug trip contact, and the trip current can disconnect one or more power contacts in the receptacle from a power source.

The system can further include an enclosure having the receptacle and a trip breaker. The trip breaker can include a trip mechanism, and some embodiments of the enclosure can include an interlock mechanism coupled to a facility circuit breaker.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
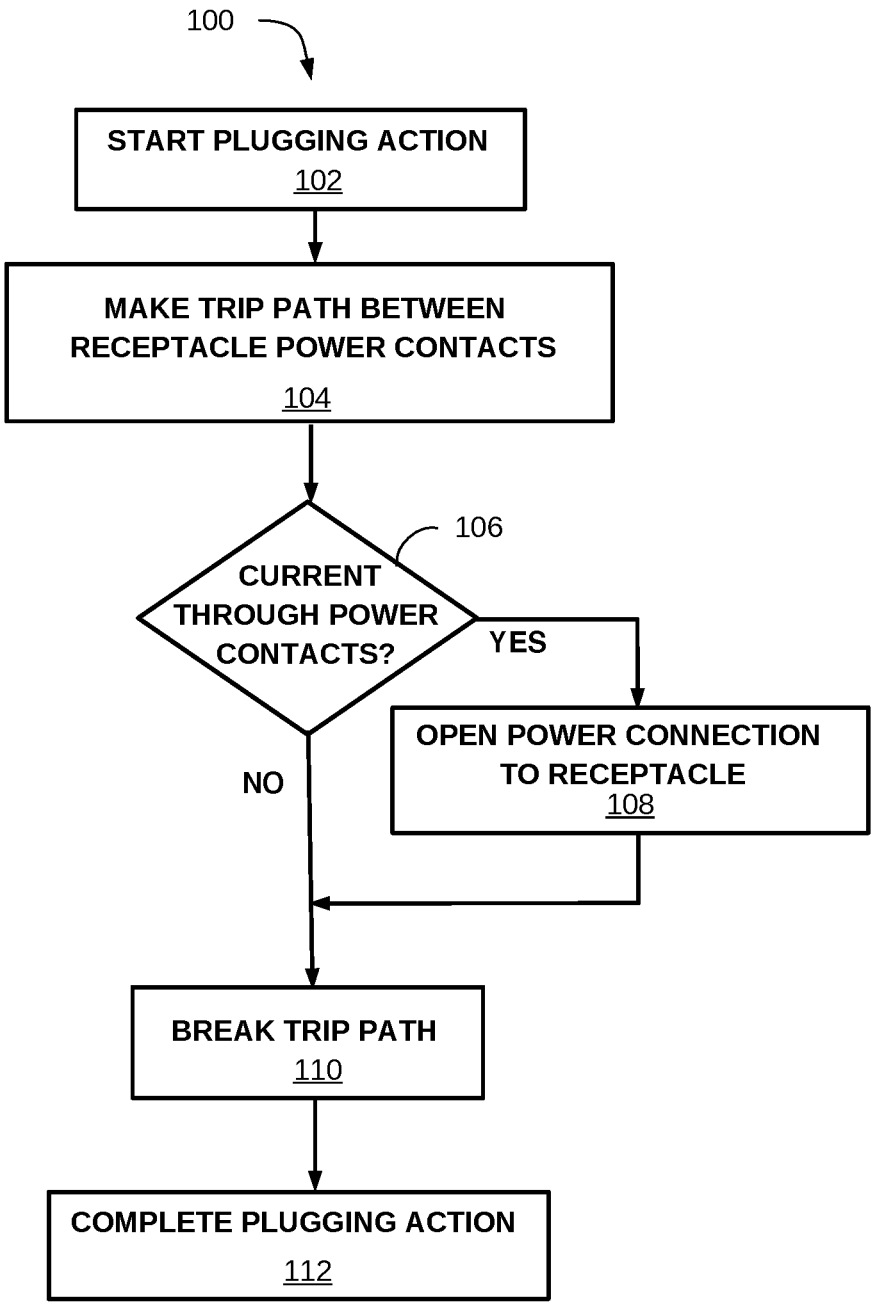
FIG. 1 is a flowchart illustrating an example method for preventing an electrical arc, according to aspects of the disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure (hereinafter, the disclosure) relate to connecting and/or disconnecting a power cord and plug, to or from an electrical device, to a power receptacle. In particular, the disclosure relates to protecting against electrical arc during connection to, and/or disconnection from a receptacle while electrical power is provided to the receptacle. While the present disclosure is not necessarily limited to such applications, various aspects of the disclosure may be appreciated through a discussion of various examples using this context.

As used herein, "electrical device" refers to an electrical, or electronic, device capable of receiving Alternating Current (AC) and/or Direct Current (DC) electrical power (hereinafter, "power") from an external power source. Examples of electrical devices include electric motors, computers or computer chassis, computing system elements (compute nodes in a multi-node computer, storage devices or subsystems, network gateways, etc.), power transformation systems (e.g. AC to DC transformer, or DC to AC inverters), and so forth.

An external power source for an electrical device can be electric utility power, other sources of power provided within a building, transformed (e.g., AC to DC) power whether utility or other sources). An electrical power source can be a mobile power source, such as, a vehicle-mounted or another mobile electrical power generator. An external power source can be, for example, a power distribution rack. Such a rack can receive utility power from another power source and provide receptacles to plug electrical devices such as, for example, a computer, or nodes of a multi-node computer or computing system. As used herein, "facility" refers to any such source of power to which an electrical device can connect to receive power.

Conventionally, a plug at one end of a power, or "line" cord, connected to an electrical device, can connect to a facility receptacle to receive facility power to provide to the device. A facility receptacle (hereinafter, "receptacle") is typically associated with the facility itself, such as attached to, or built into, a facility wall or power distribution chassis. A line cord and plug are then typically associated with an electrical device to connect to the receptacle to draw facility power. The plug and receptacle include mating power contacts of particular electrical polarities, such as AC and/or DC positive and negative polarity contacts, AC neutral polarity contacts, individual phase polarity contacts in a multi-phase AC power facility, and (in some embodiments) a ground polarity contact.

A plug and receptacle can connect by various means, such as pins (e.g., on a plug) and mating sockets (e.g., in a receptacle). While a plug can be associated with pins, and a receptacle with sockets, a receptacle can, alternatively include pins (sometimes recessed within a cavity into which a plug inserts) and a plug can include mating sockets. Other embodiments of receptacles and plugs can include other forms or types of contact points, such as raised or sliding metal contacts on each of the plug and receptacle designed to mate to each other when the plug is connected to the receptacle. It would be apparent to one of ordinary skill in the art that a contact can be any form or design of an electrically conductive surface on each of a plug and receptacle that can mate when the plug and receptacle are connected.

As used herein, "plugging action" refers to any action connecting or disconnecting a plug and a receptacle. While it can be the case that facility power is disconnected, or shut off, from a receptacle prior to a plugging action, performing a plugging action while the receptacle is energized (i.e., receiving power) can occur. As used herein, a "hot plug" or, interchangeably, "hot plugging", action refers to a plugging action performed while the receptacle is connected to and receiving power (e.g., one or more power contacts in the receptacle are connected to a facility power source).

Hot plug actions can present electrical safety hazards. As one example, when connecting a plug to, or disconnecting a plug from, an energized receptacle (referred to herein, respectively, as a "connection event" and "disconnection event"), a sudden, uncontrolled surge of power to the electrical device can result in injury to a human performing the hot plug action, and/or damage to the device, the plug and/or receptacle, or other equipment within or connected to facility power.

As another example, during a connection event, as power contacts (e.g., pins) of the plug get within a particular distance of energized receptacle power contacts (e.g., sockets), prior to the plug and receptacle power contacts making contact with each other, an uncontrolled electrical "arc" (hereinafter, "arc") can occur, through the intervening air, between the plug contacts and receptacle contacts. Similarly, when disconnecting a plug from an energized receptacle, as power contacts (e.g., pins) of the plug break connection with energized power contacts (e.g., sockets) of a receptacle, an uncontrolled arc can occur between plug and receptacle power contacts. In both cases, the flow of electric charge through a normally non-conductive medium (e.g., air) into a nearby conductive material can pose an electrical safety hazard.

An equation known as "Paschen's Law" gives the voltage necessary to start an electric arc in a gas as a function of pressure and gap length. A connection event involving high voltage AC or DC power (e.g., 120 to 480 Volts AC, or 380 to 520 Volts DC) can result in an arc between power contacts of a plug and receptacle at small distances (e.g., within about a millimeter) between them. Arcs associated with a connection event can pose electrical hazards but may be contained in (i.e., the electrical arc held within) the space between the plug and receptacle and extinguished as the plug and receptacle make full contact.

In contrast, an arc associated with a disconnection event can be drawn out and away from the receptacle. As contact is broken between a plug and an energized receptacle, an effect known as the Townsend Avalanche can result in electrical arcs, at the voltage of the facility power, extending outward from the receptacle to the plug for several millimeters and, correspondingly, can energize nearby conductive devices or materials, or a human performing a hot disconnection action. Such arcs can deliver potentially instantaneous high current flow, outside of the receptacle, which can pose a risk of electrocution, or damage to other nearby devices. Accordingly, embodiments of the disclosure (hereinafter, "embodiments") can prevent electrical arc when connecting or disconnecting a plug and receptacle when the receptacle, and/or power contacts within the receptacle, are energized.

FIG. 1 illustrates example method 100 to prevent arcing during a hot plugging action. Method 100 can be embodied, for example, by varying designs of a plug and/or receptacle. Accordingly, to illustrate the method but not intended to limit embodiments, the method is described in the context of a particular design of a plug and receptacle that are configured to create a temporary electrically conductive path between power contacts of the receptacle.

At 102, a plugging action is initiated. For example, at 102 a human can start to connect or disconnect the plug and a receptacle. At 104, while performing the plugging action, the plug and receptacle make a temporary electrically-conductive path, referred to herein as a "trip path", between at least two of the power contacts. If, at 106, the receptacle is receiving (or, connected to) power from a power source (e.g., facility power), the trip path draws power from one of the receptacle power contacts directly through the other receptacle power contact and, at 108, opens a connection (e.g., opens a circuit breaker) providing power to the receptacle.

For example, at 106 if one or more of the receptacle contacts has power connected to it, a current, referred to herein as a "trip current", can flow over the trip path between the receptacle power contacts. The trip current can, for example, cause a circuit breaker between the facility power and the receptacle, or one or more of the receptacle power contacts, to open and remove electrical power from the receptacle, or receptacle power contact(s). On the other hand, if at 106 there is not power to receptacle power contacts in the trip path (e.g., power is switched off to the receptacle), there is no trip current flow through the trip path to cause a breaker to break a connection between the facility power and receptacle is not broken (e.g., the circuit breaker is not opened).

At 110, as the plug and receptacle complete making the connection or disconnection, the plug and receptacle break the trip path and, at 112, the plugging action between the plug and receptacle completes. Completing the plugging action makes (when connecting the plug and receptacle) or breaks (when disconnecting the plug and receptacle) full contact between mating power contacts of each of the plug and receptacle.

As previously discussed, a receptacle and plug design that prevents electrical arcs during connection and disconnection events can reduce or prevent electrical hazards associated with arcing. FIGS. 2-7 illustrate example receptacles and plugs that can prevent such arcs. In FIGS. 2 through 7, cross-hatched areas represent conventionally-used non-conductive materials of a plug and receptacle, such as plastic or rubber that may be used to form the body of a plug and/or receptacle. Also, while not shown in the drawings included in the present application, it would be understood by one of ordinary skill in the art that embodiments of a plug and/or receptacle can include ground contacts (e.g., pins and/or sockets) and that an electrical ground comprises an electrical "polarity" within the scope of the disclosure.

Figure 2:
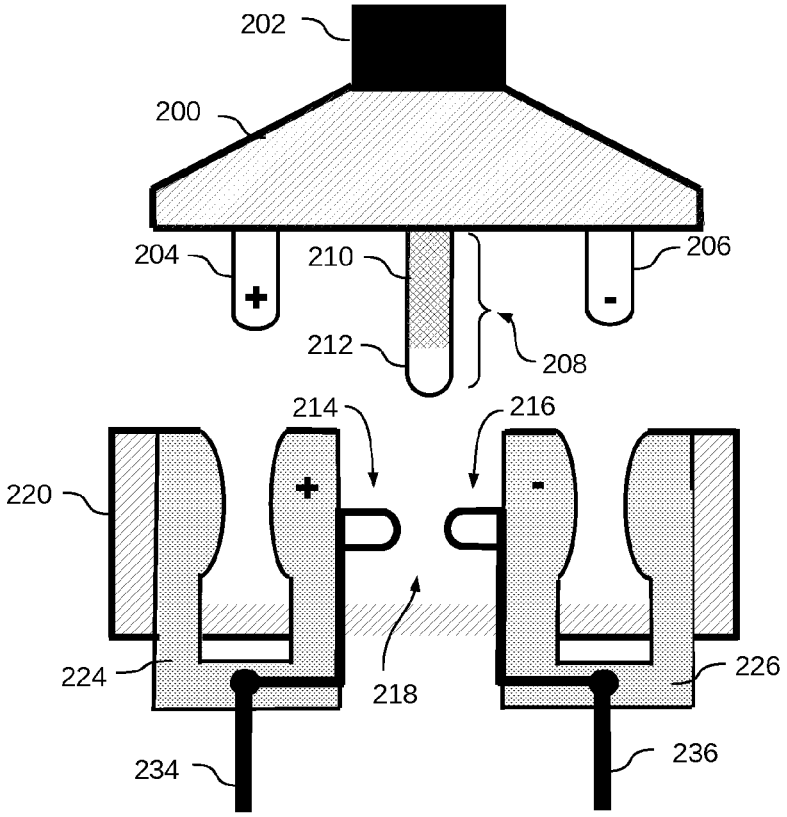
FIG. 2 is a block diagram illustrating an example electrical receptacle and plug, according to aspects of the disclosure.

As shown in FIG. 2, receptacle 220 includes positive polarity contact (socket) 224, and negative polarity contact (socket) 226. Receptacle 220 contacts 224 and 226 connect to facility power through wires 234 and 236, respectively. Plug 200 includes line cord 202, which can connect plug 200 to an electrical device (not shown). Plug 200 also includes positive polarity contact (pin) 204 and negative polarity contact (pin) 206, which can mate, when plug 200 is connected to receptacle 220, to sockets 224 and 226, respectively, to provide power from the receptacle to a device connected to line cord 202. While FIG. 2 illustrates the plug and receptacle contacts as pins and sockets, respectively, it would be apparent to one of ordinary skill in the art that mating contacts in a plug and receptacle can have alternative geometries or mating schemes.

Receptacle 220 further includes trip contacts 214 and 216, located within trip pin socket 218, and which connect electrically to sockets 224 and 226, respectively. Plug 200 includes trip pin 208, which can insert into, or otherwise mate with, trip pin socket 218 to contact trip contacts 214 and 216 when connecting and/or disconnecting plug 200 and receptacle 220. Trip pin 208 is further comprised of a non-conductive region, 210, and a conductive tip, 212. Pins 204, 206, and 208, and trip contacts 214 and 216 within receptacle 220, are configured such that when connecting plug 200 to receptacle 220, tip 212 makes simultaneous contact, referred to herein as a "trip connection", with trip contacts 214 and 216, to create a trip path, prior to pins 204 and 206 making contact with the respective sockets 224 and 226.

For example, trip pin 208 can be configured in plug 200 to be longer than plug power pins 204 and 206 and trip contacts 214 and 216 can be configured within receptacle 220 such that, when connecting plug 200 to receptacle 220, pin 208—and, in particular, tip 212—makes a trip connection with the trip contacts 214 and 216 prior to pins 204 or 206 making contact with respective contacts 224 and 226. Conductive tip 212 can be a relatively short fraction (e.g., approximately 5 to 10 percent) of the length of trip pin 208, with non-conductive region 210 comprising the remaining length of trip pin 208. Conductive tip (or, region) 212 of trip pin (or, contact) 208 can be, for example, a length sufficient to sustain, without damage, an instantaneous (e.g., short circuit) current, corresponding to a voltage of the receptacle power sockets, through the conductive tip but need not necessarily be any longer.

FIG. 2 illustrates an example length of trip pin 208 as relatively longer than power pins 204 and 206. As will be seen in more detail in reference to FIG. 4, trip pin 208 is configured to have a length, with respect to power pins 204 and 206, such that, when connecting plug 200 to receptacle 220, conductive tip 212 of pin 208 makes a trip connection with trip contacts 214 and 216, making a trip path between trip contacts 214 and 216 through trip pin 208, prior to either of pins 204 and 206 reaching a proximity to respective receptacle power sockets 224 and 226 likely to produce an electrical arc between pins 204 and/or 206 and the respective sockets 224 and 226 when power is present to either or both of sockets 224 and 226.

Such proximity can depend on various factors but can be associated particularly with the breakdown voltage of the gas (e.g., air) between receptacle 220 and plug 200. For example, at higher voltages (e.g., 220 volts), the proximity at which an arc can occur between pins of a plug and sockets of a receptacle (or, other forms or geometries of plug and receptacle power contacts) can be greater than that of lower voltages (e.g., 110V). At some voltages, a proximity at which an arc can occur can be, for example, about 1 millimeter, while at other (e.g., higher) voltages the proximity can be, for example, about several millimeters.

FIG. 2 further illustrates placement of receptacle trip contacts 214 and 216 at an example depth within trip socket 218 such that, when plug 200 and receptacle 220 are fully connected (as will be described in more detail with reference to FIG. 3), conductive tip 212 does not make a trip connection with receptacle trip contacts 214 and 216, and does not form a trip path through trip pin 208. For example, trip contacts 214 and 216 can be placed at a depth in the receptacle sufficiently less than the length of the non-conductive region of trip pin 208, such that when the plug and receptacle are fully connected, and trip pin 208 is fully inserted into receptacle 220 trip socket 218, conductive tip 212 does not make a trip connection with receptacle trip contacts 214 and 216.

Figure 5:
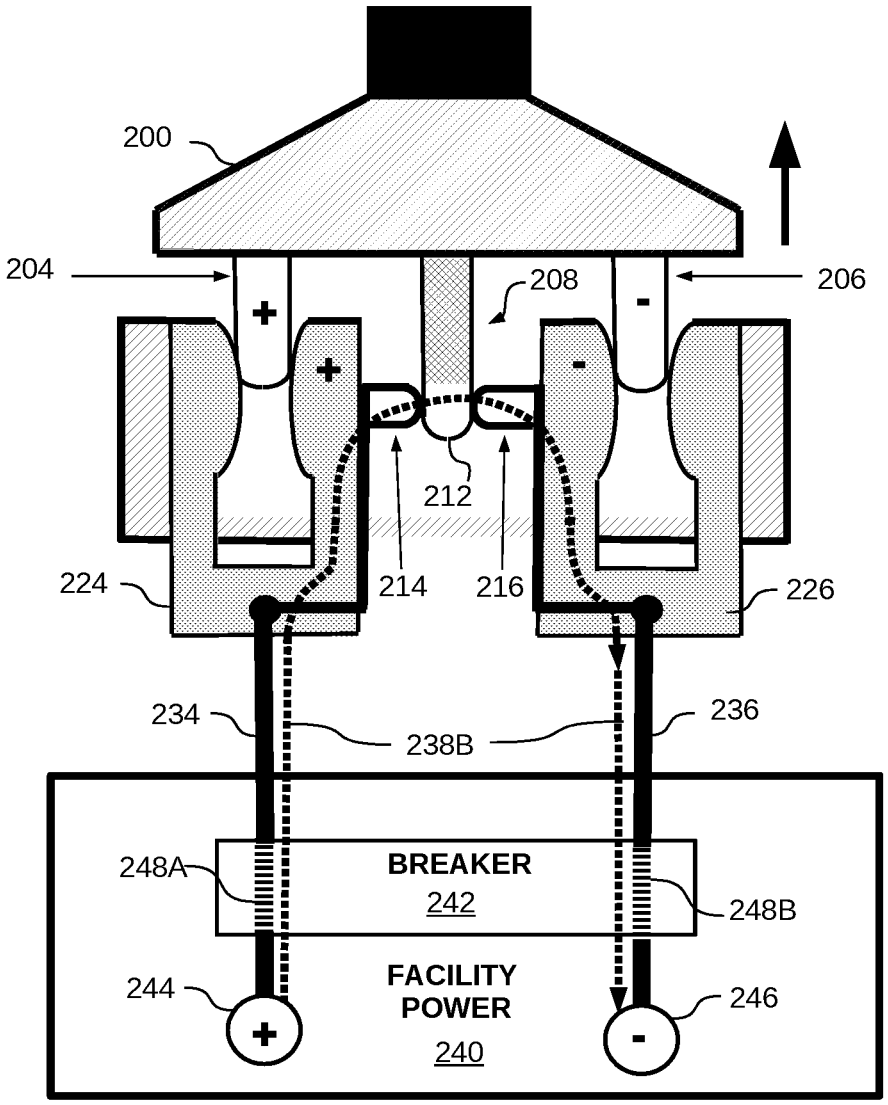
FIG. 5 illustrates example trip contacts creating a current flow during disconnection to a receptacle, according to aspects of the disclosure.

Similarly, as will be seen in more detail in reference to FIG. 5, placement of trip contacts 214 and 216 at the example depth within trip socket 218 and sizing of the length of conductive tip 212 on trip pin 208 can enable conductive tip 212 to make a trip connection with trip contacts 214 and 216 prior to either of pins 204 and 206 breaking contact (and, thereby preventing a potential arc) with the respective power sockets 224 and 226 when plug 200 is unplugged from receptacle 220.

While FIGS. 2-5 illustrate example, relative relationships between the length of a trip and power pins in a plug, non-conductive and conductive regions of a plug trip pin, and placement of trip contacts within a trip pin socket of a receptacle, particular lengths and/or depths, or other particular geometries of plug and receptacle trip contacts will depend on particular design and/or geometries of the plug and receptacle, and their respective power and trip contact types and/or geometries, and the particular voltages of power provided through the receptacle to the plug. Accordingly, determination of such particular lengths and/or depths, or other particular geometries of plug and receptacle trip contacts, can be done by, for example, laboratory measurements directed to those geometries and/or voltages.

Figure 3:
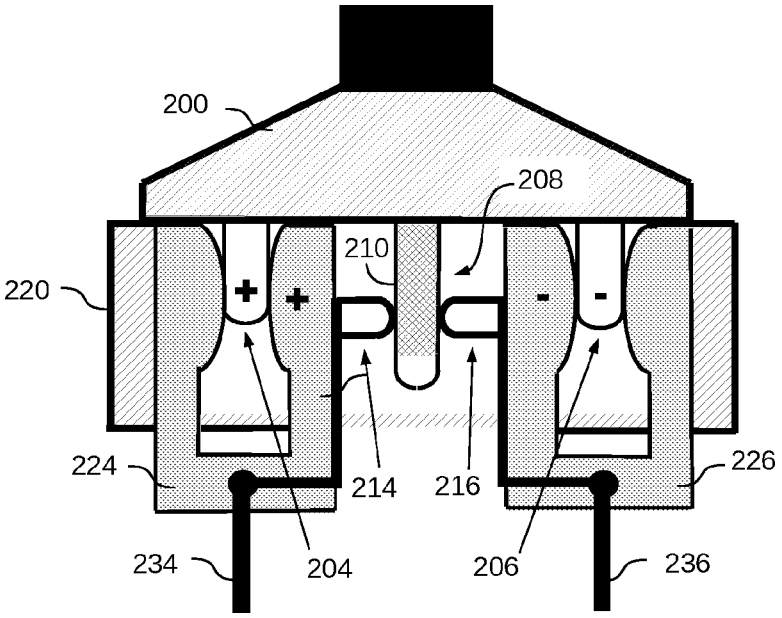
FIG. 3 illustrates an example plug fully mated to an electrical receptacle, according to aspects of the disclosure.
Figure 4:
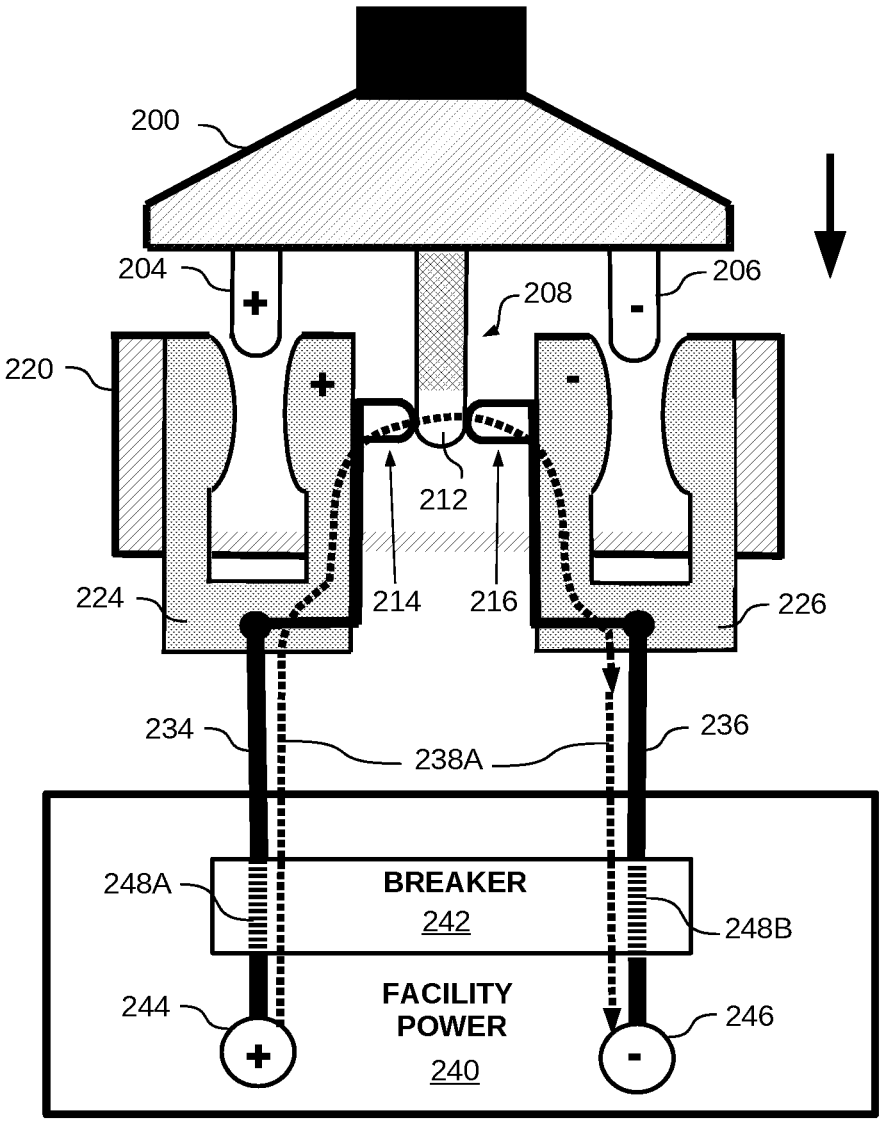
FIG. 4 illustrates example trip contacts creating a current flow during connection to a receptacle, according to aspects of the disclosure.

FIG. 2 illustrates example plug 200 and example receptacle 220 in a fully disconnected configuration. FIGS. 3, 4, and 5 illustrate the example plug and receptacle of FIG. 2, respectively, in a fully connected configuration, in a plugging action connecting the plug and receptacle, and in a plugging action disconnecting the plug and receptacle. Reference numbers utilized in preceding figures are duplicated in subsequent figures, where they refer to identical elements. For example, FIGS. 3, 4, and 5 all utilize reference numbers from FIG. 2 where elements of FIG. 2 are present in those subsequent figures. Similarly, FIGS. 4 and 5 utilize reference numbers from FIG. 2 and FIG. 3, where elements of FIGS. 2 and 3 are present in subsequent FIGS. 4 and 5, and so forth.

FIG. 3 illustrates plug 200 and receptacle 220, of FIG. 2, in a fully connected configuration. As shown, pins 204, 206, and 208, and trip contacts 214 and 216 within receptacle 220, are further configured such that when plug 200 is fully connected to receptacle 220, pins 204 and 206 are in contact with receptacle 220 sockets 224 and 226, respectively, and non-conductive region 210 of trip pin 208 is interposed between receptacle trip contacts 214 and 216. Receptacle 220 can be further configured such that, when plug 200 is fully connected to receptacle 220, conductive tip 212 does not make a trip connection with trip contacts 214 and 216.

Non-conductive region 210 interposed between receptacle trip contacts 214 and 216, and conductive tip 212 not in contact with trip contacts 214 and 216, can thereby prevent a conductive path between trip contacts 214 and 216 through trip pin 208. Accordingly, when wires 234 and 236 are connected to and receiving facility power, a current can flow through a device connected to plug 200 from wire 234, through receptacle socket 224 to plug pin 204, through the device, and back to wire 236, through plug pin 204 to receptacle socket 224. However, non-conductive region 210 interposed between trip contacts 214 and 216, in such a fully connected configuration, can prevent any current flow between trip contacts 214 and 216 through trip pin 208.

A power facility can include a circuit breaker to protect the facility power, and/or equipment connected to the plug and/or receptacle, from current loads above a particular facility rated power or current capacity, and in particular instantaneous high currents. A conventional circuit breaker can sustain power, or current, loads above a particular, rated capacity for a certain period of time, so as to avoid premature opening of a circuit (e.g., in response to a short term increase in current load when starting an electrical motor). However, conventional circuit breakers have a "trip curve" that describes the time it will take them to trip based on multiples of the rated current. This trip curve usually contains an "instantaneous switching region" in which the circuit breaker is can also be designed to trip, or open, the breaker contacts in a very short, near instantaneous, amount of time (e.g., about $1/60^{th}$ of a second (1 cycle of 60 Hz AC), or about 16.7 milliseconds). A breaker can trip in response to a current load that can correspond, for example, to a current through the breaker exceeding a particular level (e.g., 8 or more times the rated current or power of the circuit breaker).

FIG. 4 illustrates a connection event, connecting plug 200 and receptacle 220, of FIG. 2, with one or both of receptacle power sockets 224 and 226 energized by facility power provided to receptacle 220 from facility power 240. In FIG. 4, facility power 240 includes circuit breaker 242, which can open and close breaker contacts 248A and 248B to disconnect or connect, respectively, power to respective wires 234 and 236. To connect receptacle 220 to facility power 240, wire 234 connects receptacle socket 224 to facility positive polarity power 244, through breaker contact 248A, and wire 236 connects receptacle socket 226 to facility negative polarity power 246 through breaker contact 248B.

When current loads are within the rated capacity of facility power 240 or breaker 242 ratings, breaker 242 closes breaker contacts 248A and 248B to permit current to flow between facility power polarities 244 and 246 and wires 234 and 236, respectively. However, a low resistance (relative to the voltage of facility power polarities) electrical path (e.g., a short-circuit path) between facility power polarities, such as between polarities 244 and 246, can result in a current (e.g., a short-circuit current) within an instantaneous switching range of breaker 242. Accordingly, if current 238A is within the instantaneous switching range of the breaker, circuit breaker 242 can open one or both of breaker contacts 248A and 248B to remove power from receptacle 220.

Tip 212 of plug trip pin 208, making a trip connection with trip contacts 214 and 216, can create a low resistance (e.g., short-circuit) connection between facility positive power wire 234 and facility negative power wire 236, through receptacle socket 224 and trip contact 214, pin 208 (i.e., tip 212 of pin 208) and receptacle trip contact 216 and socket 226. As illustrated in FIG. 4, when connecting plug 200 to receptacle 220, as plug 200 is brought into contact with receptacle 220, prior to plug 200 pins 204 and 206 making contact with receptacle sockets 224 and 226, respectively, trip pin 208 tip 212 makes a trip connection with receptacle 220 trip contacts 214 and 216 to create a trip path between receptacle sockets 224 and 226.

When power is provided to the receptacle (e.g., one or both of contacts 224 and 226), the trip path created by tip 212 and trip contacts 214 and 216 allows trip current 238A to flow between sockets 224 and 226 and wires 234 and 236, correspondingly, between facility power positive polarity 244 and facility power negative polarity 246. If conductive tip 212 has relatively low electrical resistance (approximately near zero Ohms), the conductive path created by tip 212 and trip contacts 214 and 216 can be effectively a short-circuit between facility positive and negative power polarities and trip current 238A can be an instantaneous current within the instantaneous switching range of breaker 242 and can cause breaker 242 to open one or both of breaker contacts 248A and 248B to remove power from receptacle 220. Opening the facility breaker contacts within a period of time less than the typical time to connect a plug to a receptacle (e.g., less than about 200 milliseconds) and can remove power to the receptacle prior to the power contacts of the plug and receptacle becoming near enough to cause an arc.

FIG. 5 illustrates the example plug and receptacle of FIG. 2 during a disconnection event. As previously described in reference to FIG. 3, while fully connected the non-conductive region of trip pin 208 is interposed between trip contacts 214 and 216 can prevent a current flow between receptacle power contacts 224 and 226 through trip pin 208. As illustrated in FIG. 5, as plug 200 is brought out of contact with receptacle 220 during a disconnection event, trip pin 208 tip 212 makes a trip connection with receptacle 220 trip contacts 214 and 216, creating a trip path prior to plug 200 pins 204 and 206 breaking contact with receptacle sockets 224 and 226, respectively.

The trip path through tip pin 208 tip 212 and trip contacts 214 and 216 allows trip current 238B to flow from facility power positive polarity 244 to facility power negative polarity 244, which can result in a trip current that can cause breaker 242 to open breaker contacts 248A and/or 248B, removing power from receptacle 220. As previously described, opening the facility breaker contacts within a period of time less than the typical time to connect a plug to a receptacle and can remove power to the receptacle prior to the power contacts of the plug and receptacle becoming near enough to cause an arc.

While the examples of FIGS. 4 and 5 illustrate a plug trip contact making a trip connection with trip contacts in a receptacle, prior to any of the plug power contacts (e.g., 204 and 206) making (in a connection event), or breaking (in a disconnection event), contact with corresponding power contacts (e.g., 224 and 226) in a receptacle, it would be apparent to one of ordinary skill in the art that the disclosure is not limited to such configurations. Alternative embodiments can be configured, for example, to make a trip connection between a plug trip conductive contact region (e.g., a tip of a trip pin) and receptacle trip contacts prior to at least one of any contacts that connect power through the line cord to a device that closes an electrical circuit. In one such example, a plug and receptacle can be designed such that a plug trip contact conductive region makes a trip connection with receptacle trip contacts (or, in an alternative embodiment, a single receptacle trip contact) prior to only one power contact of the plug contacting a respective mating contact in the receptacle, in the case that one power contact is, for example, required to close a circuit within the facility power.

Also, while FIGS. 2 through 5 illustrate a trip connection between the plug and receptacle trip contacts creating a trip path between the receptacle power contacts through the receptacle and plug trip contacts, in embodiments the plug and receptacle trip contacts making a trip connection can create a trip path by alternative means. For example, a trip connection between the receptacle and the plug trip contacts can activate an electrical circuit to form a trip path between the receptacle power contacts without necessarily passing the conductive path through the trip contacts. It would be apparent to one of ordinary skill in the art that the plug and receptacle trip contacts making a trip connection during connection and disconnection events can create a trip path between the receptacle power contacts by a variety of other means.

Figure 6:
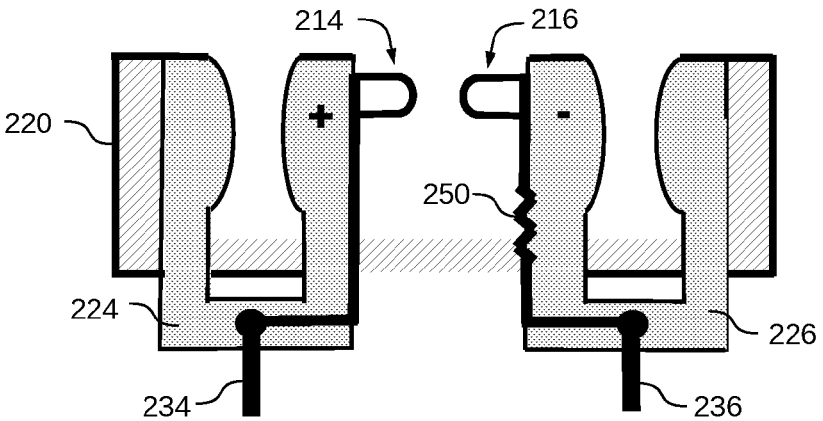
FIG. 6 illustrates an example receptacle trip contact connected to a resistor, according to aspects of the disclosure.

FIG. 6 illustrates a modification to example receptacle 220 of FIG. 2 that can enhance the ability of the receptacle to protect facility wiring and contacts (including the power and trip contacts of FIG. 2 plug 200 and receptacle 220) as a result of making a trip path between receptacle trip contacts 214 and 216 through the trip pin 208. In FIG. 6, resistor 250 is connected to the trip path in series between receptacle 220 trip contact 216 and wire 236 to present a resistive load (e.g., having more electrical resistance than conductive tip 212) in a trip path through negative trip contact 216 to wire 236. The resistive load can be, then, in series with a trip path between facility power polarities such as illustrated in FIGS. 4 and 5.

A resistive load in the trip path can reduce the trip current through trip contacts 214 and 216, and/or between facility power polarities. The resistive value of resistor 250 can be fixed, for example according to particular design requirements of the facility, or facility power, and/or the design of the plug and/or receptacle. Alternatively, resistor 250 can be a variable resistor (e.g., a potentiometer) which can be adjusted based on, for example, the facility's maximum output power to a particular receptacle of the type illustrated by FIG. 6. Resistor 250 can be adjusted based on, in another example, the type of circuit breakers installed in the path between a receptacle and the facility power so as to ensure, for example, that the trip current reaches the instantaneous switching range of the breaker but remains below a level that could damage any of the elements in the trip path, and/or connected to the plug, receptacle, and/or facility power.

Further, while shown in FIG. 6 as connected in series between receptacle trip contact 216 and wire 236, resister 250 need not necessarily be connected as shown. For example, resister 250 can be connected in series between receptacle contact 214 and wire 234, between wire 236 and facility power connected to wire 236, or between wire 234 and facility power connected to wire 234. It would be apparent to one of ordinary skill in the art that resister 250 can be connected in series between any components of receptacle 220, and/or a mating plug having a trip contact, that places it in series with trip receptacle contacts 214 and 216, and/or a trip path.

Figure 7:
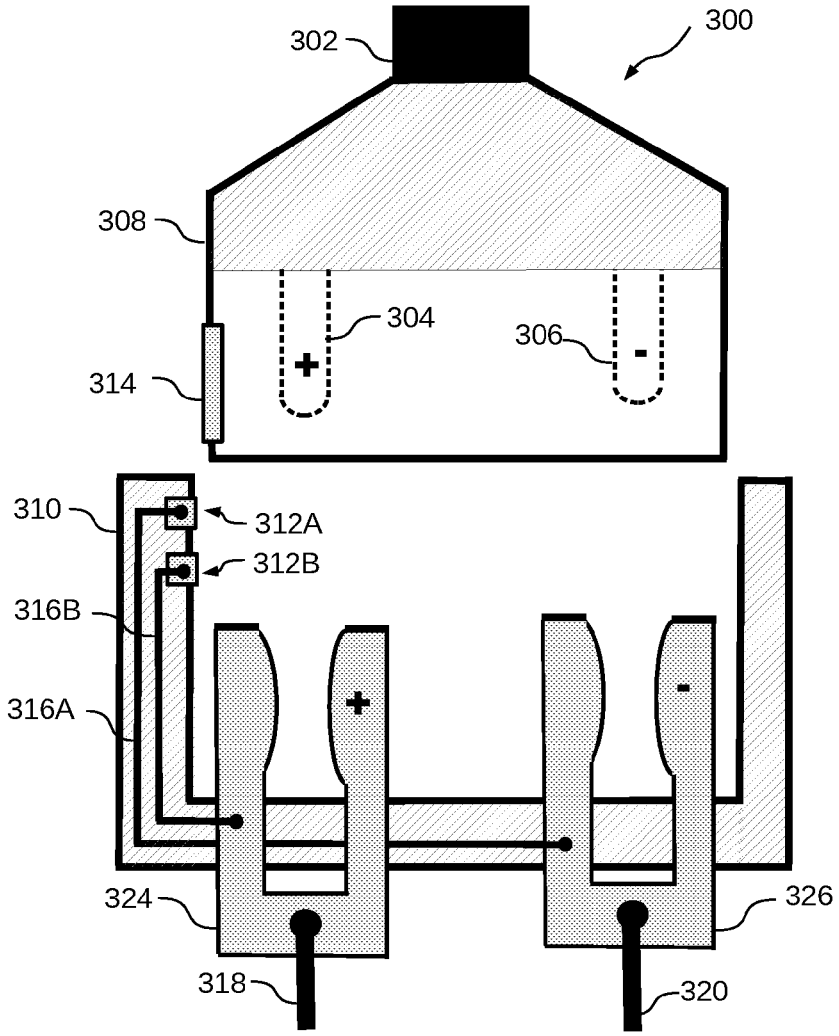
FIG. 7 illustrates an alternative example configuration of trip contacts, according to aspects of the disclosure.

FIG. 7 illustrates an alternative example of a plug and receptacle having a different trip contact configuration. In FIG. 7, example plug 300 has power contacts (pins) 304 and 306 which mate to receptacle 310 power contacts (sockets) 324 and 326, respectively. Plug 300 can connect to an electrical device by means of line cord 302, and receptacle contacts 324 and 326 can connect to facility power by means of wires 318 and 320, respectively through a protective circuit breaker. Plug 300 illustrates an example of a plug in which the plug power contacts, 304 and 306, are indicated by dashed hidden lines as recessed within a shell, 308, of plug 300.

Plug 300 includes trip contact 314 mounted on shell 308 of plug 300. Receptacle 310 similarly includes trip contacts 312A and 312B (collectively, "trip contacts 312"), mounted on an inner surface of receptacle 310, and connected, respectively, by means of wire 316A to contact 326 and wire 316B to contact 324 of the receptacle.

Trip contacts 314 and 312 are configured (e.g., positioned) on plug 300 and receptacle 310, respectively, such that the operation of connecting plug 300 and receptacle 310 places trip contact 314 in contact with trip contacts 312, creating a trip connection between receptacle 310 power contacts 324 and 326, prior to plug power contacts 304 and 306 making contact with respective receptacle power contacts 324 and 326. Trip contacts 314 and 312 are further configured (e.g., positioned) on plug 300 and receptacle 310, respectively, such that the operation of disconnecting plug 300 and receptacle 310 places trip contacts 314 in contact with trip contacts 312, creating a trip connection between receptacle 310 power contacts 324 and 326, prior to plug power contacts 304 and 306 breaking contact with respective receptacle power contacts 324 and 326. In either case, if receptacle 310 is receiving facility power at either or both of receptacle contacts 324 and 326, a trip path between receptacle 310 power contacts 324 and 326 can produce a trip current that can, in turn, cause a circuit breaker to disconnect facility power from one or both of wires 318 and 320.

A "line wire", as used herein, refers to wires in a line cord that connect an electrical device to power contacts in a plug, and "facility wire" refers, herein, to wires in a facility connecting facility power to power contacts in a receptacle. While a facility may provide a circuit breaker to protect line wires, facility wires, and/or electrical components connected to facility power, as previously described making a short-circuit, or sufficiently low resistance, trip path during a plugging action can result in a trip current of high amperage through elements in a trip path, which can include those line wires, facility wires, and/or connected electrical components.

Accordingly, alternative embodiments can include an enclosure for a receptacle and a "trip breaker", included within the enclosure, that can disconnect receptacle power contacts from facility power at amperage levels of a trip current below the rated amperage levels for each individual line or facility wire, components in a trip path, and/or components that connect to line and/or facility wires. Such a trip breaker can also potentially disconnect power faster than conventional facility circuit breakers (e.g., faster than about 1 cycle of 60 Hertz AC power).

Figure 8:
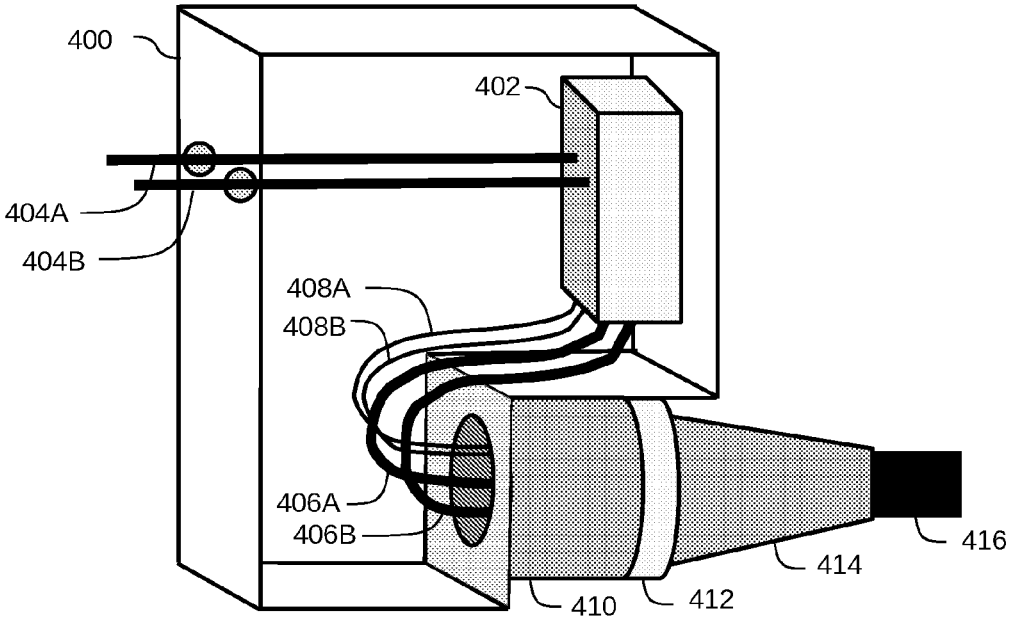
FIG. 8 illustrates an example enclosure for a receptacle, according to aspects of the disclosure.

FIG. 8 illustrates an example of an alternative embodiment including a trip breaker. Receptacle 410 is coupled to or, alternatively, molded with or otherwise a component of, enclosure 400. Trip breaker 402 is included within enclosure 400. Plug 414 connects to receptacle 410 to provide facility power to a device by means of line cord 416, which can include line wires to connect the device to power contacts in plug 414. Optionally, plug 414 can include a retaining ring, shown in FIG. 8 as 412, that can, for example, be threaded to mate with threads on receptacle 410 to mechanically maintain a connection between plug 414 and receptacle 410. (In other embodiments, a receptacle can, optionally, include a retaining ring that mates to threads on a plug).

Receptacle 410 receives facility power through trip breaker 402 by means of facility wires 406A and 406B (which can be wires of polarities previously described) connected to breaker 402, and breaker 402 in turn receives facility power to provide to wires 406A and 406B by means, respectively, of facility wires 404A and 404B connected to facility power (not shown). Trip breaker 402 further includes disconnect wires 408A and 408B connecting receptacle 410 to breaker 402. As will be seen from a discussion of FIG. 9 to follow, disconnect wires 408A and 408B can operate to open breaker connections, internal to breaker 402, that connect wires 404A and 404B to wires 406A and 406B, respectively, and can thereby disconnect power from receptacle 410 at potentially lower amperage current, and potentially faster (according to relative breaker disconnect times), than current through a facility circuit breaker, such as breaker 242 in FIG. 2.

FIG. 8 illustrates a particular example geometry and configuration of an enclosure and receptacle and trip breaker components. However, it would be apparent to one of ordinary skill in the art that the particular geometry, and/or configuration, of the enclosure, receptacle, and trip breaker are not required to be as shown in FIG. 8 and other geometries and configurations are possible.

Figure 9:
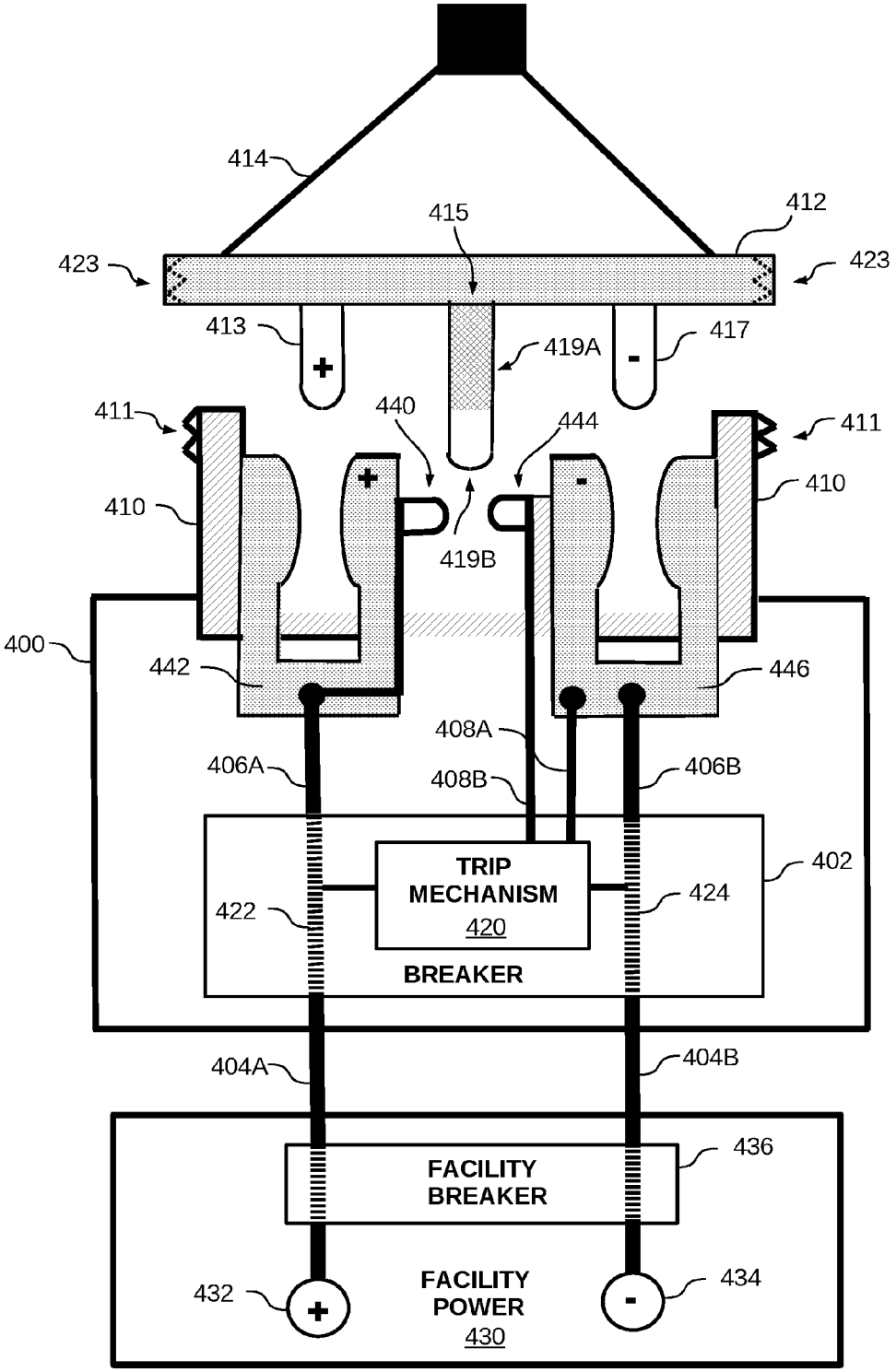
FIG. 9 illustrates an example trip breaker, according to aspects of the disclosure.

FIG. 9 illustrates example enclosure 400, trip breaker 402, receptacle 410, and plug 414 of FIG. 8 in more detail and in the context of a connection to facility power through a facility circuit breaker. As previously described, where elements of FIG. 9 are identical to elements of FIG. 8, FIG. 9 uses the same reference numbers to identify the identical elements. Also, in FIGS. 9, 10A, and 10B cross-hatched areas represent conventionally-used non-conductive materials of a plug and receptacle, such as plastic or rubber that may be used to form the body of a plug and/or receptacle.

As shown in FIG. 9, receptacle 410 includes positive polarity power contact 442 and negative polarity power contact 446. Trip breaker 402 can receive power from facility power 430 through facility breaker 436, connecting facility positive power polarity 432, on facility wire 404A, to breaker contact 422 of breaker 402, and connecting facility negative power polarity 434, on facility wire 404B, to breaker contact 424. Breaker contacts 422 and 424 in turn connect the facility power received on facility wires 404A and 404B to receptacle 410 on respective facility wires 406A and 406B. While preferred, facility breaker 430 can be optional, as trip breaker 420 can serve, in some embodiments, to disconnect receptacle power contacts 442 and/or 446 from the respective facility power polarities 432 and 434 (e.g., by disconnecting facility wires 404A and/or 404B from facility power polarities 432 and 434).

Plug 414 includes positive polarity power contact 413, negative polarity power contact 417, and trip pin 415, which is illustrated as similar to trip pin 208 of FIG. 2, having a non-conductive region 419A (indicated by cross-hatching within trip pin 415) and conductive tip 419B. Receptacle 410 further includes trip contacts 440 and 444. Similar to plug 200 and receptacle 220 of FIG. 2, a plugging action between plug 414 and receptacle 410 can place conductive tip 419B of trip pin 415 in contact with receptacle trip contacts 440 and 444, to create a trip connection, prior to receptacle contacts 442 and/or 446 making (during a connection plugging action) or breaking (during a disconnection plugging action) contact with respective power contacts 413 and 417 in plug 414.

As can be seen in FIG. 9, trip contact 440 can connect through conductive tip 419B to power contact 442 in the same manner that FIG. 2 illustrates trip contact 214 connecting to power contact 224 of receptacle 220. However, receptacle 410 differs from receptacle 220 in that trip contact 444 connects to power contact 446 through trip mechanism 420, included within trip breaker 402. Thus, wires 408A and 408B include trip mechanism 420 in a trip path (or, circuit) between power contacts 442 and 446, through trip contact 440, tip 419B, and trip contact 444. A trip current through trip mechanism 420 can, in turn, cause trip mechanism 420 to open one or both of breaker contacts 422 and 424, respectively connecting wires 406A and 406B to respective wires 404A and 404B, to remove power from receptacle 410 respective power contacts 442 and/or 446.

Trip mechanism 420 can operate in a variety of conventional manners to open one or more breaker connections in response to receiving a trip current. For example, a trip current received by trip mechanism 420 on wires 408A and 408B can energize a conventionally known electromagnet, which can operate to mechanically push or pull breaker contacts 422 and/or 424 to their open circuit positions. It would be apparent to one of ordinary skill in the art that there are variety of conventionally-known mechanisms to open a breaker connection in response to receiving a trip current through a trip mechanism such as 420.

It would further be apparent to one or ordinary skill in the art that breaker 402 need not disconnect both (or, in embodiments having more than two receptacle power contacts, more than two) receptacle power contacts from a facility power source. Rather, in embodiments, it can be sufficient to disconnect only one, or a subset, of the power contacts within a receptacle from the facility power source to remove power from other, or all, receptacle power contacts.

Plug 414 is further illustrated in FIG. 9 as including retaining ring 412, which can be commonly utilized in conventional plug and receptacle designs to provide extra mechanical protection against accidental disconnection of a plug from a receptacle. Retaining ring 412 is shown having internal (female) threads 423, indicated by the dashed hidden lines within retaining ring 412, that can thread onto mating external (male) threads 411 of receptacle 410. When plug 414 is fully connected to receptacle 410, and retaining ring screwed onto receptacle 410 by means of the respective threads, retaining ring 412 prevents accidental disconnection of plug 414 from receptacle 410 (i.e., one must intentionally unscrew retaining ring 412 from receptacle 410 in order to disconnect plug 414 from receptacle 410). In alternative embodiments, a retaining ring can be an element of a receptacle, instead of a plug, such that the plug contains male threads to mate to female threads of the receptacle retaining ring. However, in embodiments, a retaining ring—whether an element of a receptacle or a plug—and/or other mechanical retaining apparatus, can be optional.

Figure 10A:
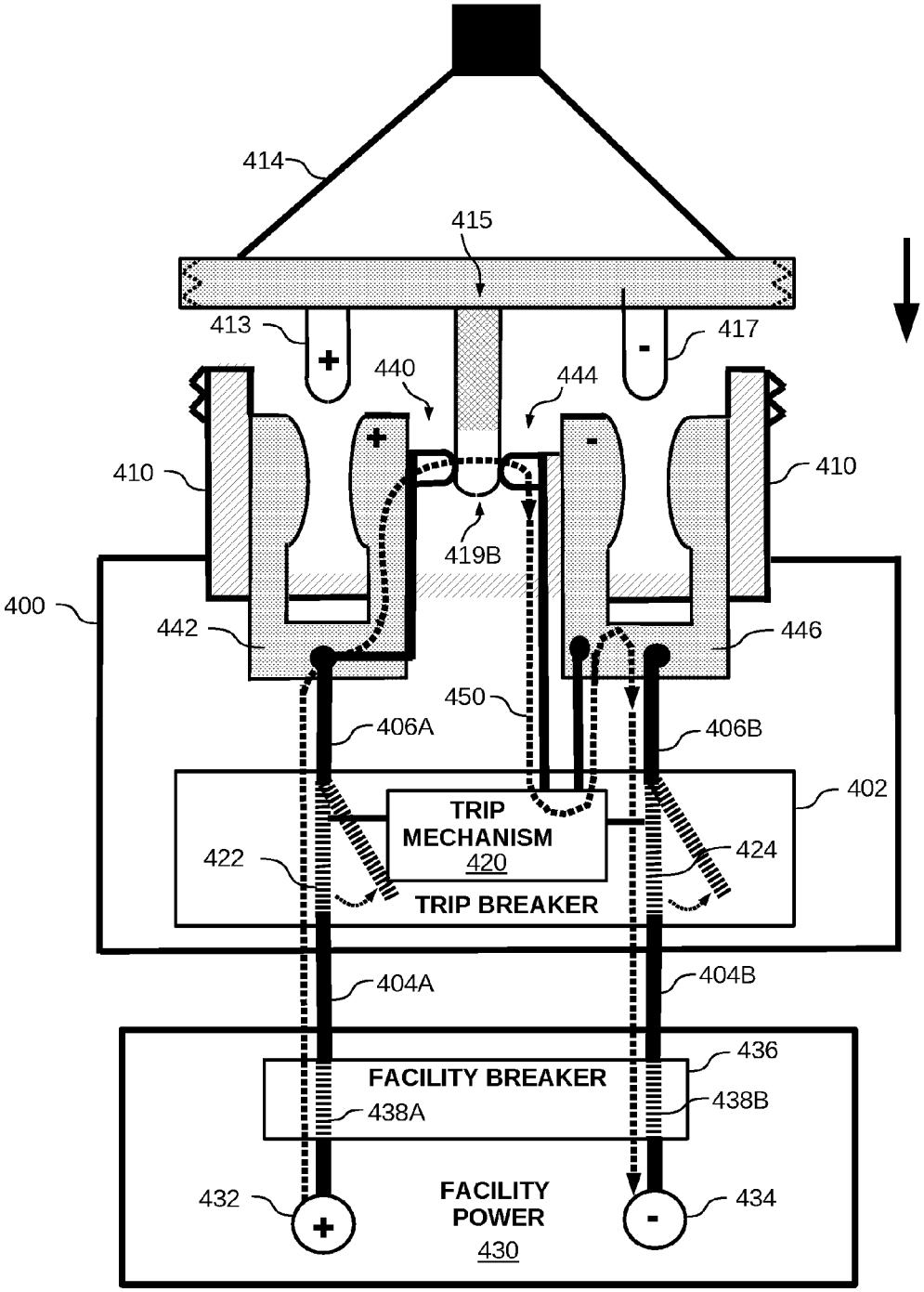
FIG. 10A illustrates example trip contacts creating a current through a trip mechanism, according to aspects of the disclosure.
Figure 10B:
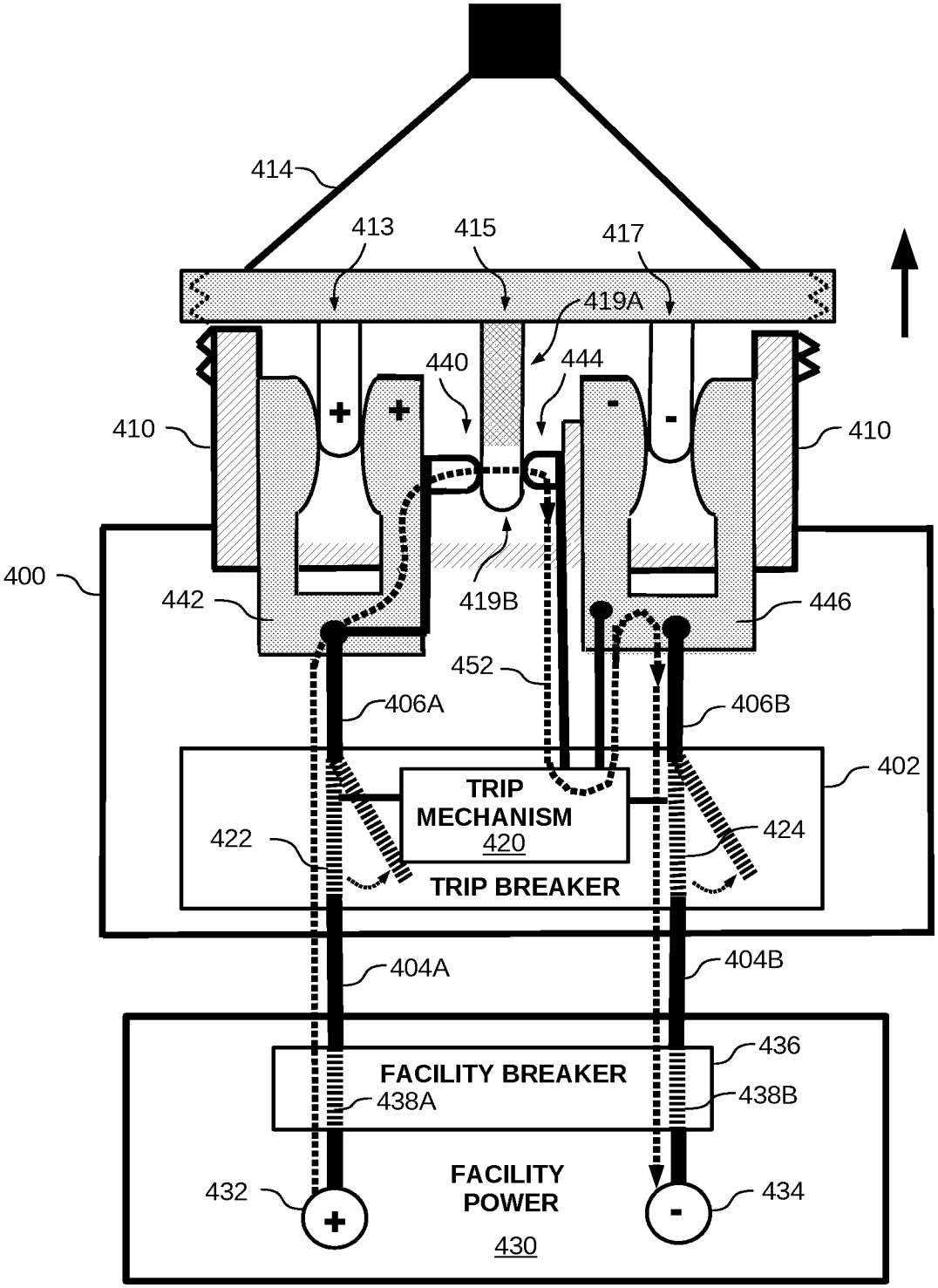
FIG. 10B illustrates a second example of trip contacts creating a current through a trip mechanism, according to aspects of the disclosure.

FIGS. 10A and 10B illustrate example plugging actions utilizing the example enclosure, plug, and receptacle of FIGS. 8 and 9. FIGS. 10A and 10B utilize the same reference numbers as FIGS. 8 and 9 to identify and reference elements of FIGS. 10A and 10B that are identical to elements of FIGS. 8 and 9.

FIG. 10A illustrates a connection action involving connecting plug 414 to receptacle 410. An action connecting plug 414 to receptacle 410 places conductive tip 419B of trip pin 415 in contact with receptacle trip contacts 440 and 444, creating a trip connection between receptacle trip contacts 440 and 444, prior to either or both of plug power contacts 413 and 417 making contact with receptacle power contacts 442 and/or 444, respectively. A trip path between receptacle trip contacts 440 and 444 further includes trip mechanism 420 and connects facility positive polarity power 432 and negative polarity power 434 through receptacle power contacts 442 and 446. When receptacle 410 is receiving power from facility power 430, trip current 450 can flow on the trip path through trip mechanism 420. Trip current 450 can cause trip mechanism 420 to open one or both of trip breaker 402 connections 422 and 424 to wires 404A and 404B, respectively, thereby removing facility power from receptacle 410 prior to plug power contacts 413 and 417 making contact with receptacle power contacts 442 and 446, respectively, and preventing an arc between them.

Trip mechanism 420 can be designed such that a trip current (e.g., 450) that causes trip mechanism 420 to open breakers 422 and/or 424 can be a lower amperage than a current required to open breaker contacts 438A and/or 438B in facility breaker 436. For example, facility breaker 436 can be designed to open breakers 438A and/or 438B in response to a current of 100 or more amps. The instantaneous switching range of such a breaker can be, for example, in the range of 800 A. Trip mechanism 420 can be designed to open breaker contacts 422 and/or 424 in response to a trip current of, for example, 10 amps in its instantaneous switching range due to facility power not passing directly through trip mechanism 420. In this manner, trip breaker 402 can provide additional protection to equipment connected to plug 414, facility wiring, and power components connected over facility breaker 436 during a hot plug connection action with receptacle 410. In this manner, trip breaker 402 can provide additional protection to equipment connected to plug 414, line and/or facility wiring, and power components connected over facility breaker 436 during a hot plug disconnection event with receptacle 410.

FIG. 10B illustrates a disconnection event involving disconnecting plug 414 from receptacle 410. While plug 414 is fully connected to receptacle 410, trip contact 415 prevents a conductive (e.g., trip) path between receptacle trip contacts 440 and 444 through trip pin 415, similar to the manner of trip contact 208 as described in reference to FIG. 3. Non-conductive region 419A prevents a current flow through trip mechanism 420 from receptacle power contacts 440 and 444 when receptacle 410 is receiving power from facility power 430.

Similar to the connection action described with reference to FIG. 10A, an operation disconnecting plug 414 from receptacle 410 places conductive tip 419B of trip pin 415 in contact with receptacle trip contacts 440 and 444, creating a trip connection between receptacle trip contacts 440 and 444, prior to either or both of plug power contacts 413 and 417 breaking contact with respective receptacle power contacts 442 and/or 446. As previously described in referent to FIG. 10A, the trip path includes trip mechanism 420 and connects facility positive polarity power 432 and negative polarity power 434 through receptacle power contacts 442 and 446. When receptacle 410 is receiving power from facility power 430, trip current 452 can flow on the trip path through trip breaker 402 and can cause trip mechanism 420 to open one or both of trip breaker contacts 422 and 424, hereby removing facility power from receptacle 410 prior to the plug and receptacle power contacts breaking contact with each other and preventing an arc between them.

Also as previously described in reference to FIG. 10A, trip mechanism 420 can be designed such that trip current 452 can cause trip mechanism 420 to open breaker contacts 422 and/or 424 at a lower amperage than a current required to open breaker contacts 438A and/or 438B. In this manner, trip breaker 402 can provide additional protection to equipment connected to plug 414, line and/or facility wiring, and power components connected over facility breaker 436 during a hot plug disconnection event with receptacle 410.

In embodiments, a mechanical (or, in some embodiments, an electromechanical) interlock mechanism can provide additional protection against connecting and/or disconnecting a plug and receptacle while power is provided to the receptacle. An interlock mechanism can, for example, obstruct a plug to prevent inserting the plug into a receptacle or withdrawing the plug from the receptacle. Opening or closing the interlock mechanism can be associated with (e.g., required to perform prior to) connecting or disconnecting facility power (e.g., switching on or off at a facility power switch). In embodiments, opening or closing an interlock mechanism can be combined with a trip breaker to cause the trip breaker to open and/or close a connection (e.g., a trip breaker contact) to facility power.

FIGS. 11 and 12A-12D illustrate an example interlock mechanism using a modification of FIG. 8 enclosure 400 and trip breaker 402, in combination with example plug 414 and receptacle 410 as shown in FIG. 9. Where elements of FIGS. 11 and 12A-12D are identical to elements of FIGS. 8 and 9, FIGS. 11 and 12A-12D utilize the same reference numbers as FIGS. 8 and 9 to identify those elements.

Figure 11:
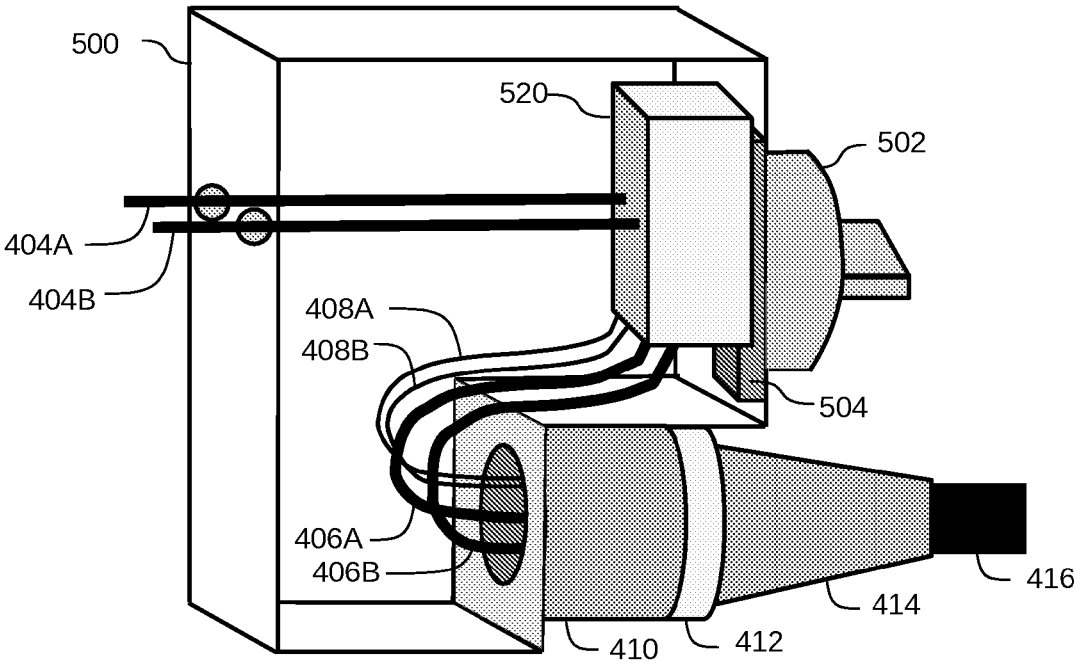
FIG. 11 illustrates an alternative example enclosure for a receptacle, according to aspects of the disclosure.

In FIG. 11, enclosure 500 represents a modified example of FIGS. 8 and 9 enclosure 400. Enclosure 500 includes modified trip breaker 520, which will be shown to be a modified example of trip breaker 402 shown in FIGS. 8 and 9. Enclosure 500, and components thereof, are accordingly understood to connect to facility power 430 in the same manner that enclosure 400, and components thereof, are shown in FIGS. 8 and 9 to connect to facility power.

Enclosure 500 includes handle 502, which will be shown in FIGS. 12A-12D to have positions that can obstruct connecting and disconnecting plug 414 and receptacle 410, and positions that do not obstruct connecting and disconnecting plug 414 and receptacle 410, providing a mechanical interlock mechanism for connecting and disconnecting plug 414 and receptacle 410. Handle 502 can, for example, rotate into an open position that permits connecting plug 414 to receptacle 410 or, conversely, that permits disconnecting plug 414 from receptacle 410. Handle 502 can further rotate into a closed position that prevents connecting and disconnecting plug 414 and receptacle 410. Enclosure 500 further includes latch 504, which can be connected (e.g., mechanically), or coupled (e.g., electrically or electromechanically), to handle 502. Rotating handle 502 between an open and closed position can, in turn, manipulate the position of latch 504, as will be described in detail in FIGS. 13A and 13B.

Figure 12A:
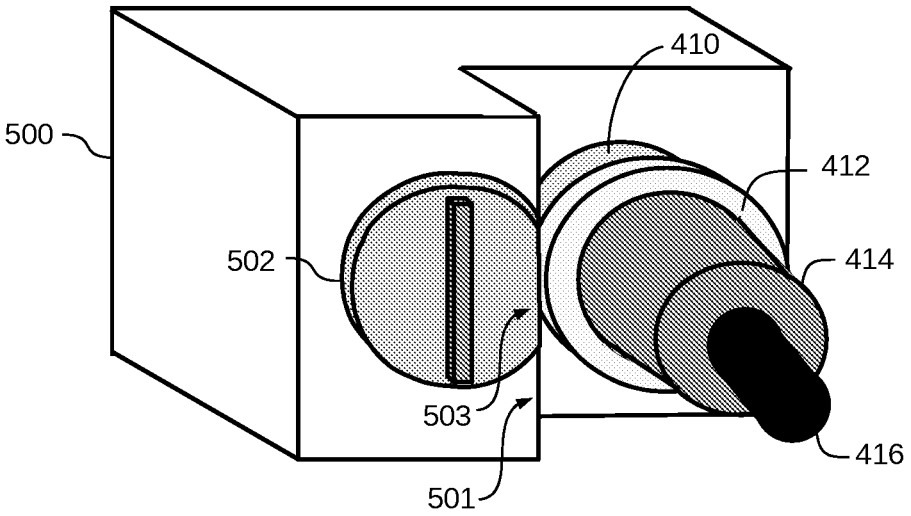
FIG. 12A illustrates an isometric view of the alternative example enclosure of FIG. 11, according to aspects of the disclosure.
Figure 12B:
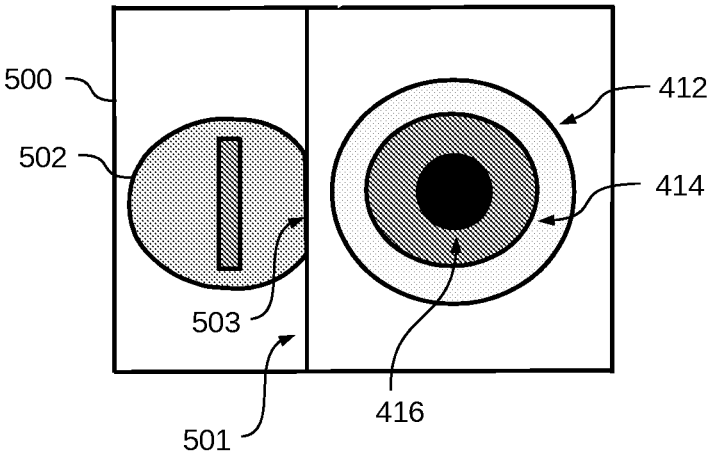
FIG. 12B illustrates a top view of the alternative example enclosure of FIG. 11, according to aspects of the disclosure.

FIGS. 12A-12D provide views of enclosure 500 that illustrate an example structure and configuration of handle 502 in an open and closed position. FIG. 12A illustrates an isometric view of enclosure 500 with handle 502 in an open position, which does not obstruct connecting and disconnecting plug 414 and receptacle 410. As shown in FIG. 12A, example handle 502 is configured to have a linear edge, 503, that can align, in an open position of handle 502, with edge 501 of enclosure 500 adjacent to receptacle 410. In this open position, handle 502 does not obstruct connecting plug 414 to, or disconnecting plug 414 from, receptacle 410. FIG. 12B illustrates a front view of the example of FIG. 12A, for added clarity of the configuration of the various components of FIG. 12A in an open position.

Figure 12C:
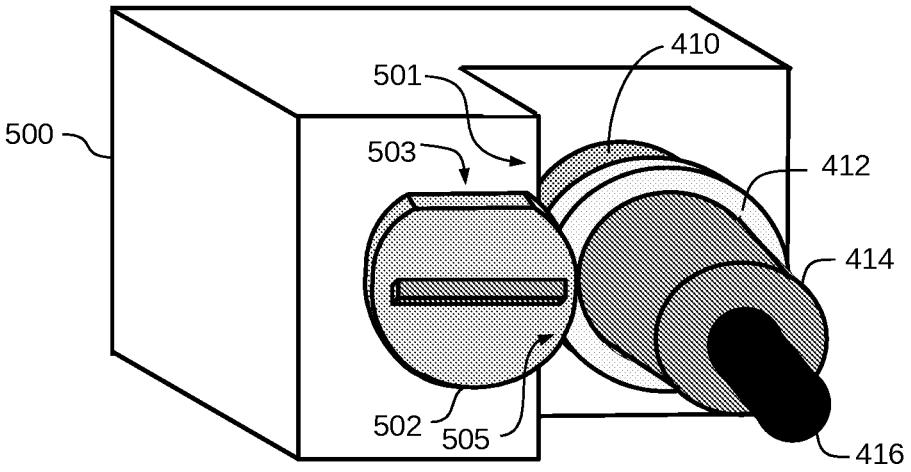
FIG. 12C illustrates a second isometric view of the alternative example enclosure of FIG. 11, according to aspects of the disclosure.
Figure 12D:
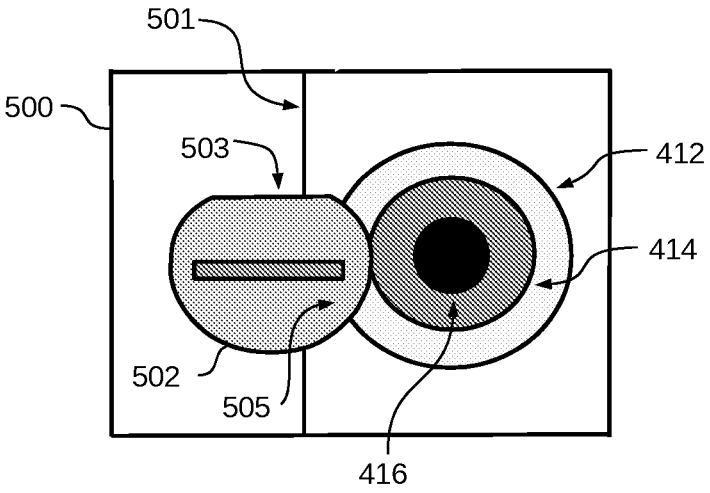
FIG. 12D illustrates a second top view of the alternative example enclosure of FIG. 11, according to aspects of the disclosure.

FIG. 12C illustrates an isometric view of enclosure 500 with handle 502 in a closed position. As illustrated in FIG. 12C, example handle 502 is configured such when rotated into a closed position, circular edge 505 of handle 502 protrudes sufficiently beyond edge 501 to overlap with, for example, retaining ring 412. In alternative embodiments, the circular edge 505 can protrude so as to overlap with other structures (e.g., a molded edge) of plug 414, instead of a retaining ring. The overlap of handle 502 with plug 414 mechanically prevents disconnecting plug 414 from receptacle 410 while handle 502 is in the closed position. Similarly, handle 502 in the closed position would prevent, by blocking retaining ring 412 (or another structure of plug 414) such that plug 414 cannot be connected, or properly connected, to receptacle 410. FIG. 12D illustrates a top view of the example of FIG. 12C, for added clarity of the configuration of the various components of FIG. 12C in a closed position.

While example handle 502 is shown FIGS. 12A-12D in a circular configuration with a linear edge (503), and as designed to rotate between an open and closed position, it would be apparent to one of ordinary skill in the art that embodiments can employ other geometries and actions of a handle having an overlap with a plug to permit or prevent connecting and disconnecting a plug and receptacle. For example, a handle can be a sliding handle that slides horizontally (or, alternatively, vertically or at some other angle) with respect to the orientation of enclosure 500 in FIGS. 12A-12D, to protrude beyond, or retract behind, an edge of enclosure 500 adjacent to receptacle 410 and obstruct a component of a plug.

The examples of FIGS. 11 and 12A-12D illustrate an interlock mechanism comprising a handle on a receptacle enclosure (or, other feature of or adjacent to a facility receptacle), to prevent connecting and disconnecting a plug and receptacle, which can provide an additional safety measure against accidental connection and disconnection events with power provided to the receptacle. However, an interlock mechanism combining a handle, and the action of opening and closing the handle, with a receptacle circuit breaker, such as breaker 402 in enclosure 400 of FIGS. 8 and 9, can further improve the safety of a receptacle against accidental connection and disconnection events with power to the receptacle.

Figure 13A:
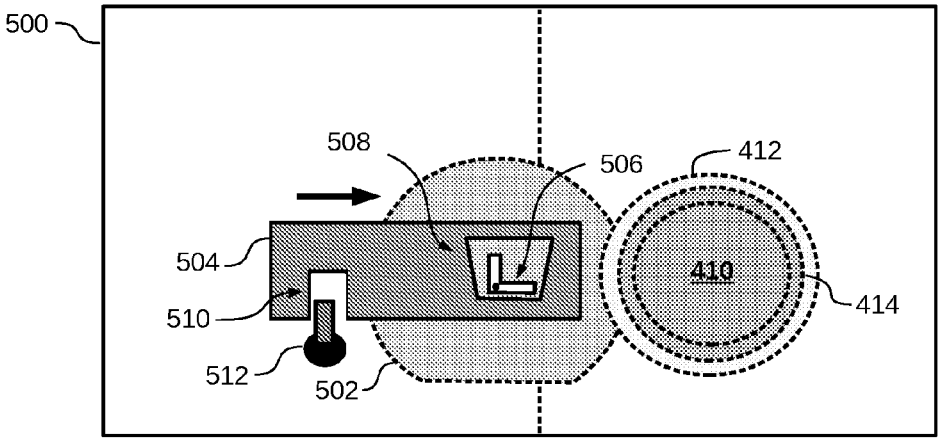
FIG. 13A illustrates an example handle, latch and actuator in one position, according to aspects of the disclosure.
Figure 13B:
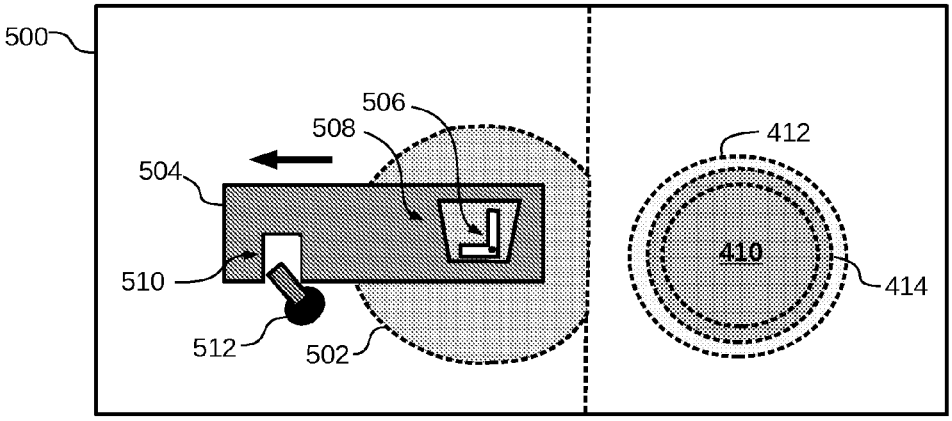
FIG. 13B illustrates the example handle, latch and actuator of FIG. 13A in a second position, according to aspects of the disclosure.

Accordingly, latch 504 of FIG. 11 can be coupled to a trip breaker, such as trip breaker 402 of FIGS. 8 and 9 modified and shown in FIG. 11 as trip breaker 520. Manipulating a latch can, in turn, open and close a connection between a receptacle and facility power. FIGS. 13A, 13B, 14A, and 14B illustrate an enhanced interlock mechanism that combines a handle (e.g., 502) and latch (e.g., 504) with a trip breaker (e.g., 520) to open and close a connection between a receptacle (e.g., 410) and facility power (e.g., 430). FIGS. 13A and 13B utilize the same reference numbers as FIG. 11 to identify and reference elements of FIGS. 13A and 13B that are identical to elements of FIG. 11. Similarly, FIGS. 14A and 14B utilize the same reference numbers as FIGS. 9, 11, 13A, and 13B to identify and reference elements of FIGS. 14A and 14B that are identical to elements of FIGS. 9, 11, 13A, and 13B.

FIGS. 13A and 13B illustrate enclosure 500 as viewed from the reverse, or inside, of enclosure 500 with respect to the views of FIGS. 12A-12D. FIGS. 13A and 13B illustrate handle 502 (illustrated using broken, hidden lines) and latch 504, with latch 504 shown in more detail, in the open and closed positions of handle 502. FIGS. 13A and 13B also illustrate receptacle 410, plug 414, and retaining ring 412 illustrated by broken, hidden lines. In reference to FIGS. 13A and 13B, "clockwise", "counter-clockwise", "right", "left", "top", and "bottom" are with respect to the orientation of the views of enclosure.

FIG. 13A shows example latch 504 having notches 508 and 510, and example handle 502 having a slide mechanism, slider 506, mounted on (for example) the bottom of handle 502. Latch 504 can be mounted, for example, inside of enclosure 500, behind handle 502, and handle 502 can be mounted on enclosure 500 such that slider 506 protrudes into notch 508 and can contact (for example) the bottom, left, and right edges of notch 508. Notch 510 is shown in combination with actuator 512 inserted into notch 510. As will be described in detail in reference to FIGS. 14A and 14B, rotating (or, otherwise manipulating) actuator 512 can open and close breaker contacts within a trip breaker, such as modified trip breaker 520.

Using, for example, the configuration of notch 508 and slider 506, rotating handle 502 between an open and closed position can, in turn, slide latch 504 between a corresponding open and closed circuit position of latch 504. FIG. 13A illustrates that rotating handle 502 clockwise into the closed position of handle 502 can rotate slider 506 clockwise to press on the right edge of notch 508 and, thereby, slide latch 504 to the right. Latch 504 slid to the right orients actuator 512 vertically within notch 510 by, for example, notch 510 pressing on the portion of actuator 512 inserted into notch 510. As will be described in reference to FIGS. 14A and 14B, latch 504 rotating an actuator can be used to open or close breakers within a trip breaker, such as breaker 520 included in enclosure.

FIG. 13B illustrates the example of FIG. 13A with handle 502 rotated counter-clockwise into the open position of handle 502. Rotating handle 502 counter-clockwise into the open position can rotate slider 506 counter-clockwise to press on the left edge of notch 508 and, thereby, slide latch 504 to the left. Latch 504 slid to the left positions actuator 512 in a rotated orientation within notch 510 by, for example, notch 510 pressing on the portion of actuator 512 inserted into notch 510.

While FIGS. 13A and 13B illustrate latch 504 coupled mechanically to manipulate a physical position of actuator 512, by means of actuator 512 protruding into notch 510, the illustration is not intended to limit embodiments. For example, an embodiment can couple (e.g., electrically or electromechanically) latch 512 to an electrical circuit (e.g. utilizing an electric motor, or an electromagnet) which can manipulate actuator 512 to open or close breakers within a trip breaker. It would be apparent to one of ordinary skill in the art that a variety of mechanisms other than that illustrated in FIGS. 13A and 13B can enable latch 504 to manipulate actuator 512.

Figure 14A:
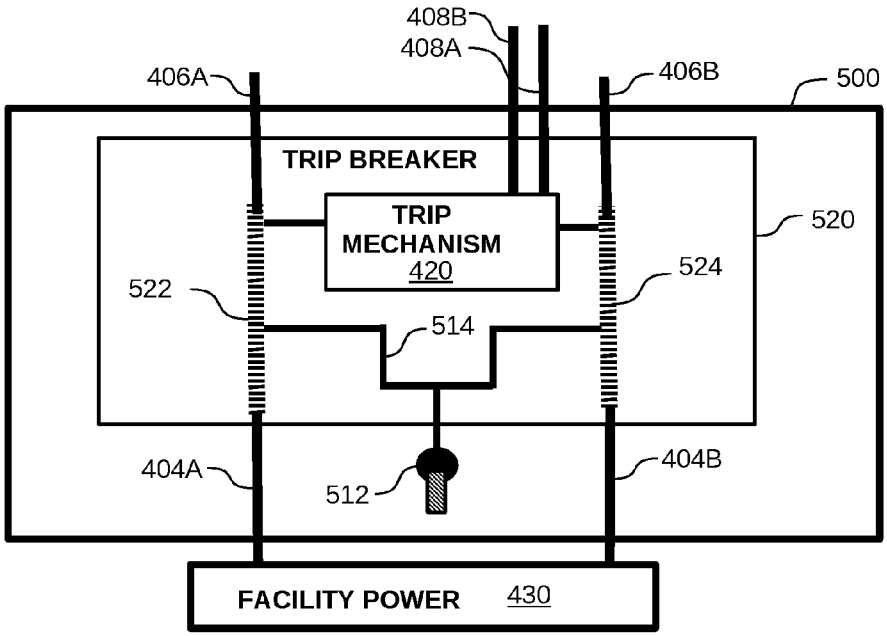
FIG. 14A illustrates the example actuator of FIG. 13A in a closed-circuit position, according to aspects of the disclosure.
Figure 14B:
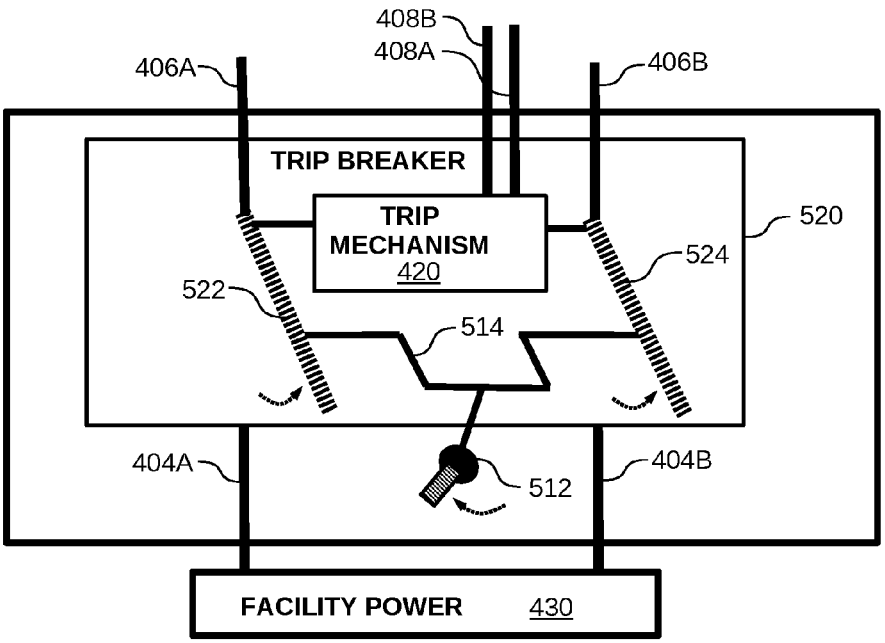
FIG. 14B illustrates the example actuator of FIG. 13B in an open-circuit position, according to aspects of the disclosure.

FIGS. 14A and 14B illustrate an example combination of actuator 512 with example trip breaker 520 to open and close breaker contacts between receptacle 410 and facility power 430, in the context of FIGS. 11, 12A-12D, 13A, and 13B. FIG. 14A shows breaker 520 breaker contacts 522 and 524 in a closed-circuit position, which connects facility wires 404A and 404B to facility wires 406A and 406B, respectively, to provide facility power on to receptacle 410 (not shown). FIG. 14A shows actuator 512 connected (e.g., mechanically) to both of breaker contacts 522 and 524 of example trip breaker 520 by means of tie-rod 514. FIG. 14A illustrates that actuator 512 in a particular orientation can position tie-rod 514 so as to place breaker contacts 522 and 524 in a closed-circuit position. For example, the vertical orientation of actuator 512 illustrated in FIG. 13A can position tie-rod 514 as shown in FIG. 14A so as to place breaker contacts 522 and 524 in a closed-circuit position.

FIG. 14B shows breaker 520 breaker contacts 522 and 524 in an open-circuit position Breaker contacts 522 and 524, in an open-circuit position, can disconnect breaker contacts 522 and/or 524 from facility wires 404A and 404B, respectively, to remove facility power to receptacle 410 (not shown). FIG. 14B illustrates that actuator 512 in a particular orientation can position tie-rod 514 so as to place breaker contacts 522 and 524 in an open-circuit position. For example, the angled orientation of actuator 512 illustrated in FIG. 13B can position tie-rod 514 as shown in FIG. 14B so as to place breaker contacts 522 and 524 in an open-circuit position.

FIGS. 14A and 14B further show trip breaker 520 including FIG. 9 trip mechanism 420. Trip mechanism 420 is connected to wires 408A and 408B and can operate, within trip breaker 520, as previously described in reference to FIGS. 10A and 10B to open breaker 520 breaker contacts 522 and 524.

While FIGS. 14A and 14B illustrate actuator 512 coupled mechanically, by means of tie-rod 514, to breaker contacts 522 and 524, the illustration is not intended to limit embodiments. Rather, it would be apparent to one of ordinary skill in the art that other mechanisms can couple an actuator to one or more breaker contacts within a breaker. For example, actuator 512 can be coupled to an electromagnetic device (not shown) within circuit breaker 520, instead of tie-rod 514, and the rotated position of actuator 512 can, for example, activate the electromagnetic device to open breaker connections 522 and 524.

It would further be apparent to one or ordinary skill in the art that breaker 520 need not disconnect both (or, in embodiments having more than two receptacle power contacts, more than two) receptacle power contacts from a facility power source. Rather, in embodiments, it can be sufficient to disconnect only one, or a subset, of the power contacts within a receptacle from the facility power source to remove power from other, or all, receptacle power contacts.

Combining actuator 512 and tie-rod 514 with trip mechanism 520 can provide a tamper-proof receptacle with enhanced safety for connection and disconnection events. "Tamper-proof", as used herein, means that even if the mechanical interlocks (e.g., 502 and/or 504) are circumvented or broken, trip mechanism 520 can still prevent electrical arc during a connection or disconnection event with power to receptacle 410. Using the examples of FIGS. 11 through 14B, connecting a plug (e.g., 414) to a receptacle (e.g., 410) can require first placing (e.g., rotating or sliding) a handle (e.g., 502) into a position that does not obstruct connecting or disconnecting the plug and receptacle. Placing the handle in the un-obstructing position can open a circuit breaker (e.g., 520) within an enclosure (e.g. 500) to which the handle is connected, for example by sliding a latch (e.g., 504), or by other means, that rotates an actuator (e.g., 512) connected to the circuit breaker.

If the handle, latch, or actuator is physically disabled (e.g., tampered with) or broken, the plug and receptacle can potentially be connected or disconnected while power is provided through the enclosed breaker to the receptacle. However, trip mechanism 520 receiving a trip current through trip contacts in the plug and receptacle, as previously described, can open the breaker contacts within the enclosed breaker to remove power from the receptacle prior to power contacts in the plug and receptacle creating an arc.

Figure 15:
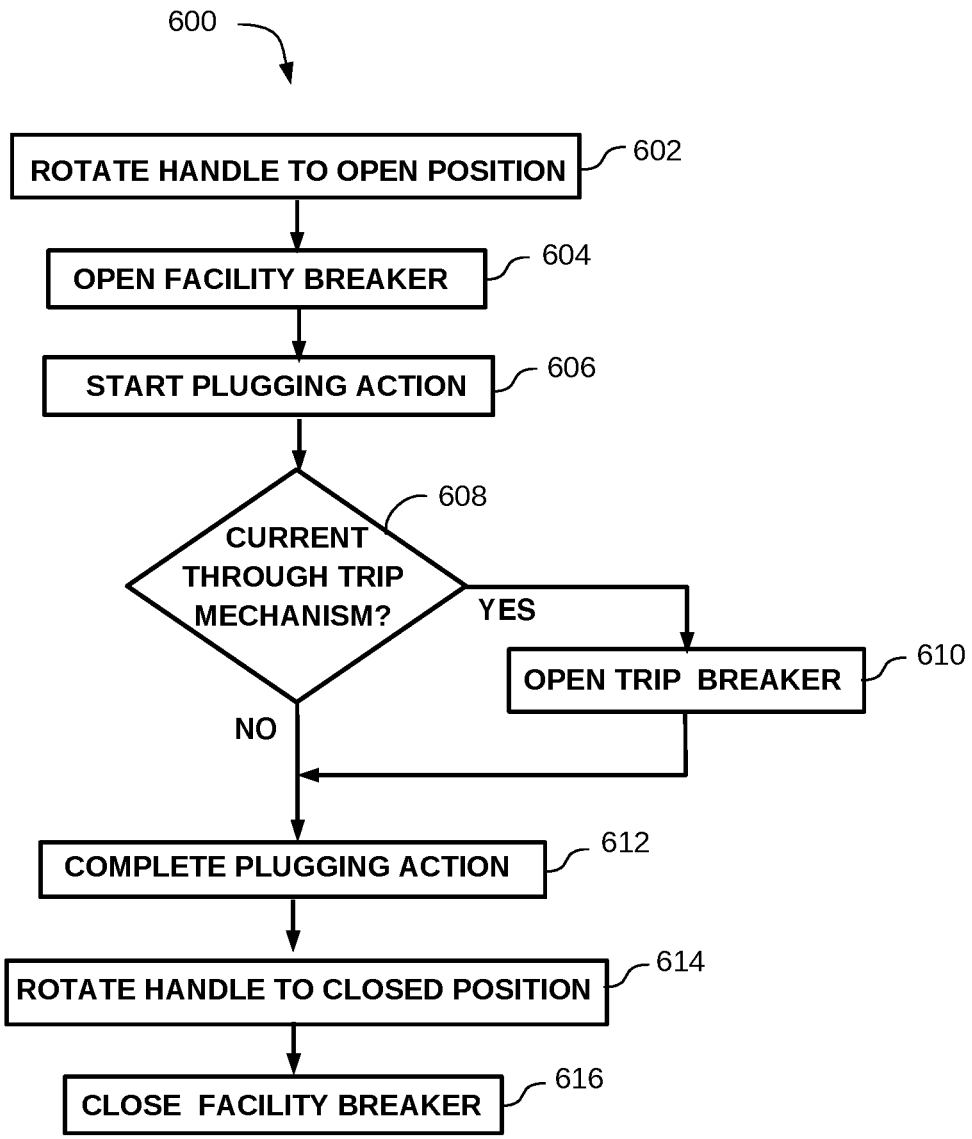
FIG. 15 is a flowchart illustrating a second example method for preventing an electrical arc, according to aspects of the disclosure.

FIG. 15 illustrates example method 600 using an interlock mechanism and a trip breaker to protect against arcing during connection and disconnection events of a plug and receptacle. For purposes of illustrating method 600, but not intended to limit embodiments, the method is described in the context of the examples illustrated in the foregoing figures, having an enclosure in the manner of enclosure 500 as shown in FIG. 11; a receptacle and plug in the manner of 410 and 414, respectively, as shown in FIG. 9; an interlock mechanism comprising a rotating handle, sliding latch, and rotating actuator in the manner of 502, 504, and 512 respectively, as shown in FIGS. 13A and 13B; and, a trip breaker in the manner of 520, as shown in FIGS. 14A and 14B.

At 602, to prepare to connect or disconnect a plug and receptacle, such as those illustrated in FIGS. 11-13B, the interlock mechanism handle (on the receptacle enclosure) is rotated (or, otherwise manipulated) to an open position. Rotating the handle to an open position can, at 604, open a connection between facility power and one or more power contacts within a receptacle. For example, using example 500 enclosure 500 previously described in reference to FIGS. 11-14B, rotating handle 502 can slide latch 504, in turn rotating actuator 512 to open breaker contacts 522 and/or 524 within trip breaker 520. In another example, an interlock mechanism handle can be mechanically, or electrically (e.g., by an electromagnet actuated by rotating the handle), coupled to a facility breaker, such that rotating the handle to an open position can open breaker connections in the facility breaker. Opening the breaker contacts can thereby prevent arcing between the receptacle and plug power contacts as the plug and receptacle are connected and/or disconnected.

Optionally, the interlock mechanism can include an obstruction that prevents connecting, and/or disconnecting, a plug and the receptacle, such as illustrated in FIGS. 11-13B. The interlock mechanism can move (e.g., rotate or slide) between a position that obstructs connecting and/or disconnecting the plug and receptacle and another position that does not obstruct those actions. Accordingly, at 602, rotating the handle to an open position can remove an obstruction (e.g., an edge of the handle) that otherwise (in any other position of the handle) prevents plugging or unplugging the plug and receptacle.

If, at 606, rotating the handle failed to open the facility breaker, power contacts in the receptacle can be remain connected to (and, receiving) facility power such that, at 606, starting a plugging action to connect or disconnect the plug and receptacle can be a hot plug action, which can in turn pose a risk of electrical arc between the plug and receptacle. Rotating the handle can fail to open the facility breaker if, for example, there is a mechanical (or, electrical) failure in a mechanism connecting the handle and a trip, or a facility, breaker, or if the handle or mechanism has been tampered with to, for example, disengage the handle from the trip or facility breaker.

If the plug and receptacle include trip contacts that can make a trip connection during a plugging action, such as described in the previous examples, and if the receptacle is receiving facility power to one or more of the power contacts, when the plugging action commences at 606 the plug and receptacle trip contacts can make a trip connection to create a trip path between power contacts in the receptacle. At 608, the trip connection can allow a trip current, such as 450 of FIG. 10A or 452 of FIG. 10B, through a trip mechanism such as 420 in FIGS. 14A and 14B, which can, at 610, open one or more trip breaker connections between the power contacts in the receptacle and facility power. In this manner, the trip mechanism can provide additional protection against an electrical arc between the plug and receptacle in the event that the interlock mechanism fails, is broken, tampered with, or otherwise disengaged from opening a connection between the receptacle and facility power.

At 612, continuing the plugging action removes the trip connection between the plug and receptacle trip contacts to break the trip path through the trip and power contacts within the receptacle. At 614, the plugging action completes and the handle is rotated into a closed position. At 616, rotating the handle can close a connection between facility power and one or more power contacts within the receptacle. For example, as previously described in reference to FIGS. 11-14B, rotating handle 502 can slide latch 504, in turn rotating actuator 512 to close breaker contacts 522 and/or 524 within trip breaker 520. If the interlock mechanism includes the optional obstruction, moving interlock mechanism can position the obstruction to prevent disconnecting the plug from the receptacle or, alternatively, to prevent re-connecting the plug and receptacle, in particular while the receptacle is receiving facility power.

Figure 16:
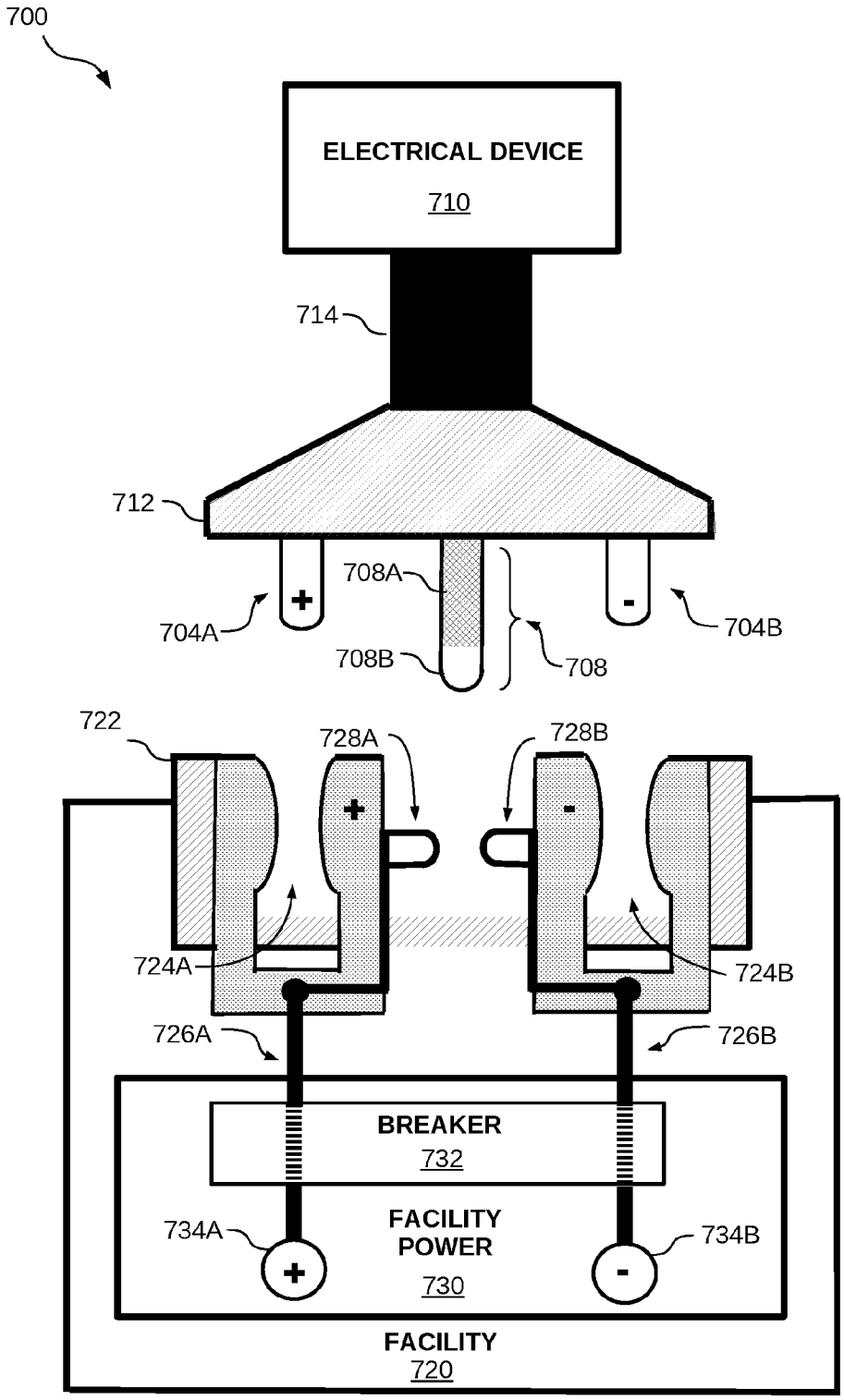
FIG. 16 illustrates an example system, according to aspects of the disclosure.

FIG. 16 illustrates an example system that includes an electrical device and utilizes a plug and receptacle similar to those previously described. FIG. 16 illustrates example system 700 comprising electrical device 710 having line cord 714 with plug 712. Electrical device 710 can be any device that receives electrical power from an external power source, such as from a facility power source. For example, electrical device 710 can be a computer (e.g., a laptop, desktop, server computer or a node of a multi-node server computer), a storage device or subsystem, a network device (e.g., a network gateway or router), an electrical motor, or an electrical power transformer (e.g., a voltage or current transformer). In some embodiments, electrical device 710 can be, for example, a power distribution rack, which can receive power from an external power source and distribute that power to multiple other devices connected to, or plugged into, power receptacles or connections within the power distribution rack. It would be apparent to one of ordinary skill in that art that embodiments can include electrical, and/or electronic, devices of a wide variety that receive electrical power from an external source.

Plug 712 mates to receptacle 722 of facility 720. Plug 712 includes plug power contacts, shown as pins, 704A and 704B (collectively, "pins 704") and trip pin 708, which can be similar to trip pin 208 of FIG. 2, having non-conductive region 708A and conductive tip 708B. While not shown in FIG. 16, power contacts 704A and 704B can be each connected to electrical device 710 (or, components thereof) by means of respective line wires included in line cord 714.

Receptacle 722 includes receptacle power contacts 724A and 724B (collectively, "sockets 724"), shown as sockets having contact walls, which connect to facility power 730 through breaker 732 by means of respective facility wires 726A and 726B. Socket 724A connects by means of wire 726A, through breaker 732, to facility positive polarity power 734A, and socket 724B connects by means of wire 726B, through breaker 732, to facility negative polarity power 734B. When plug 712 and receptacle 722 are connected, each of pins 704A and 704B can mate with sockets 724A and 724B, respectively. Receptacle 722 includes trip contacts 728A and 728B, each of which is also connected to wires 726A and 726B, respectively.

Plug 712 and receptacle 722 can be configured, similar to previous example embodiments of the disclosure, such that a plugging action between plug 712 and receptacle 722 places conductive tip 708B of trip contact 708 makes a trip connection with receptacle 722 trip contacts 728A and 728B. During the plugging action, the trip connection can create a trip path (not shown) between trip contacts 728A and 728B. When one or both of wires 726A and 726B are connected to the respective power polarities through breaker 732, the trip path can permit a trip current (not shown) to flow over wires 726A and 726B, by means of the tripping path, between facility positive polarity power 734A and facility negative polarity power 734B. The trip current can, in turn, cause breaker 732 to open one or both of the connections between wire 726A and facility positive polarity power 734A, and wire 726B and facility negative polarity power 734B.

Plug 712 and receptacle 722 can be configured, similar to previous example embodiments of the disclosure, such that a plugging action to connect plug 712 and receptacle 722 can make a trip connection between conductive tip 708B and receptacle contacts 728A and 728B, to create a trip path between receptacle power contacts 724A and 724B, prior to either of pins 704 making contact with a respective mating contact in sockets 724. Additionally, plug 712 and receptacle 722 can be configured, similar to previous example embodiments of the disclosure, such that a plugging action to disconnect plug 712 and receptacle 722 can make a trip connection between conductive tip 708B and receptacle contacts 728A and 728B, to create a trip path between receptacle power contacts 724A and 724B, prior to either of pins 704 breaking contact with a respective mating contact in sockets 724.

Also similar to previous example embodiments of the disclosure, when plug 712 and receptacle 722 are fully connected, conductive tip 708B can be place out of contact with receptacle trip contacts 728A and 728B and non-conductive region 708A can be interposed between receptacle trip contacts 728A and 728B. Non-conductive region 708A, in this fully-connected configuration of plug 712 and receptacle 722, can thereby prevent a trip current flowing between facility positive polarity power 734A and facility negative polarity power 726 through trip pin 708 and receptacle trip contacts 728A and 728B.

While not shown in FIG. 16, it would be apparent to one of ordinary skill in the art that system 700 can include receptacle 722 within an enclosure similar to enclosure 500 of FIG. 11. It would be further apparent to one of ordinary skill in the art that system 700 can include a trip breaker having a trip mechanism in a trip path formed between trip contacts 728A and 728B, and having wires 726A and 726B connected to facility breaker 732 through the trip breaker, similar to the manner in which receptacle 410 is connected through trip breaker 520 to facility power 430 in FIGS. 11, 14A, and 14B. Additionally, it would be apparent to one of ordinary skill in the art that plug 712 and receptacle 722 can configure trip contacts in the manner of plug 308 and receptacle 310 illustrated in FIG. 7, and/or that power and trip contacts in plug 712 and receptacle 722 can have geometries and configurations other that as shown in FIG. 16.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A power plug comprising:

a plurality of plug power contacts; and a plug trip contact, wherein the plug trip contact comprises an electrically conductive region and an electrically non-conductive region, and wherein the plug trip contact electrically conductive region is configured to make a trip connection, during a plugging action with the power plug and a power receptacle, between the plug trip contact and two or more mating receptacle trip contacts included in the power receptacle;

wherein the trip connection permits a trip current through the plug trip contact when at least one receptacle power contact, included in the power receptacle, is connected to electrical power provided by a power source;

wherein the trip current causes disconnection, from the electrical power, of a receptacle power contact among the at least one receptacle power contact connected to the electrical power; and wherein the plug trip contact is further configured such that, when the power plug is fully connected to the power receptacle, the plug trip contact electrically conductive region does not make the trip connection with the two or more mating receptacle trip contacts and the plug trip contact electrically non-conductive region is placed in contact with at least one of the two or more mating receptacle trip contacts, thereby preventing the trip current through the plug trip contact.

2. The power plug of claim 1, wherein the plug trip contact is further configured to break the trip connection when completing the plugging action; and wherein, when the trip current is present through the plug trip contact, the breaking the trip connection terminates the trip current.

3. The power plug of claim 1, wherein the plug trip contact is further configured to make the trip connection with the two or more mating receptacle trip contacts, when the plugging action is an action connecting the power plug to the power receptacle, prior to any of the plurality of plug power contacts reaching a proximity to produce an electrical arc with any of the at least one receptacle power contacts connected to the electrical power.

4. The power plug of claim 1, wherein the plug trip contact is further configured to make the trip connection with the two or more mating receptacle trip contacts, when the plugging action is an action disconnecting the power plug and the power receptacle, prior to any of the plug power contacts, among the set of plug power contacts, in contact with a respective mating power contact in the power receptacle, breaking the contact with the respective mating power contact in the power receptacle.

5. The power plug of claim 1, wherein each of the plurality of plug power contacts is configured to conduct electrical power comprising one of a direct current (DC) positive polarity, a DC negative polarity, a DC ground, an alternating current (AC) positive polarity, an AC negative polarity, an AC neutral, and a phase of a multi-phase AC.

6. The power plug of claim 1, wherein the plug trip contact is located on one of an outer surface of the power plug and a location on a body of the power plug.

7. A power receptacle comprising:

a plurality of receptacle power contacts; and a trip circuit, wherein the trip circuit comprises a first and a second receptacle trip contact, wherein the first and second receptacle trip contacts are configured to make a trip connection, during a plugging action with the receptacle and a power plug, with an electrically conductive region of a mating trip contact included in the plug, and wherein the trip circuit is configured to:

permit a trip current between the first and second receptacle trip contacts, when during the plugging action, at least one receptacle power contact, included in the plurality of receptacle power contacts, is connected to electrical power provided by a power source and the first and second receptacle trip contacts make the trip connection with the electrically conductive region of the mating trip contact included in the plug, wherein the trip current causes disconnection of a receptacle power contact, among the at least one receptacle power contact connected to the electrical power, from the electrical power; and wherein the trip circuit is opened, when the plug is fully connected to the power receptacle and an electrically non-conductive region of the mating trip contact included in the plug is placed in contact with the first and second receptacle trip contacts, and when the electrically conductive region of the mating trip contact included in the plug does not make the trip connection with the first and second receptacle trip contacts, preventing the trip current between the first and second receptacle trip contacts.

8. The receptacle of claim 7, wherein the first and second receptacle contacts are further configured to make the trip connection, when the plugging action is an action connecting the power receptacle and the power plug, prior to any of at least one power contact, included in the power plug, reaching a proximity to produce an electrical arc with a mating receptacle power contact among the at least one receptacle power contact connected to the electrical power.

9. The power receptacle of claim 7, wherein the first and second receptacle trip contacts are further configured to make the trip connection with the plug mating trip contact, when the plugging action is an action disconnecting the power plug and the power receptacle, prior to any receptacle power contact, among the plurality of receptacle power contacts, in contact with a respective mating power contact in the power plug, breaking contact with the respective mating power contact in the power plug.

10. The power receptacle of claim 7, wherein the power receptacle is included in an enclosure comprising a trip breaker, wherein the trip breaker includes a trip breaker contact connecting the at least one receptacle power contact and the electrical power, and wherein the tripping current causes the trip breaker to open the trip breaker contact to disconnect the at least one receptacle power contact from the electrical power.

11. The power receptacle of claim 10, wherein the trip breaker comprises a trip mechanism, configured to open the trip breaker contact in response to the trip current.

12. The power receptacle of claim 10, wherein the enclosure further comprises an interlock mechanism having an open and a closed position, wherein the interlock mechanism open position opens a connection between the at least one receptacle power contact and the electrical power, and wherein the interlock mechanism closed position closes the connection between the at least one receptacle power contact and the electrical power.

13. The power receptacle of claim 12, wherein the interlock mechanism open position opening the connection between the at least one receptacle power contact and the electrical power comprises opening a facility breaker connecting the at least one receptacle power contact and the electrical power, and wherein the interlock mechanism closed position closing the connection between the at least one receptacle power contact and the electrical power comprises opening the facility breaker connecting the at least one receptacle power contact and the electrical power.

14. A system comprising:

an electrical device;

a line cord comprising a plurality of line wires and a power plug, wherein the line cord and the plurality of line wires connect the electrical device to the power plug, wherein the power plug comprises a plurality of plug power contacts, each of the plurality of plug power contacts coupled to a respective line wire included in the plurality of line wires, and wherein the power plug further comprises a plug trip contact; and wherein the plug trip contact comprises an electrically conductive region and an electrically non-conductive region, and wherein the plug trip contact electrically conductive region is configured to make a trip connection, during a plugging action with the power plug and a power receptacle, between the plug trip contact and two or more mating receptacle trip contacts included in the power receptacle;

wherein the trip connection permits a trip current through the plug trip contact when at least one receptacle power contact, included in the power receptacle, is connected to electrical power provided by a power source;

wherein the trip current causes disconnection, from the electrical power, of a receptacle power contact among the at least one receptacle power contact connected to the electrical power; and wherein the plug trip contact is further configured such that, when the power plug is fully connected to the power receptacle, the plug trip contact electrically conductive region does not make the trip connection with the two or more mating receptacle trip contacts and the plug trip contact electrically non-conductive region is placed in contact with at least one of the two or more mating receptacle trip contacts, thereby preventing the trip current through the plug trip contact.

15. The system of claim 14, wherein the plug trip contact is further configured to make the trip connection with the two or more mating receptacle trip contacts, when the plugging action is an action connecting the power plug to the power receptacle, prior to any of the plurality of plug power contacts reaching a proximity to produce an electrical arc with any of the at least one receptacle power contacts connected to the electrical power.

16. The system of claim 14, wherein the plug trip contact is further configured to make the trip connection with the two or more mating receptacle trip contacts, when the plugging action is an action disconnecting the power plug and the power receptacle, prior to any of the plug power contacts, among the set of plug power contacts, in contact with a respective mating power contact in the power receptacle, breaking the contact with the respective mating power contact in the power receptacle.

17. The system of claim 14, wherein the electrical system further includes an enclosure that includes the power receptacle and a trip breaker, wherein the trip breaker comprises an at least one trip breaker contact connecting a respective at least one receptacle power contact and the electrical power, and wherein the tripping current causes the trip breaker to open the at least one trip breaker contact to disconnect the respective at least one receptacle power contact from the electrical power.

18. The system of claim 17, wherein the trip breaker further comprises a trip mechanism configured to open the at least one trip breaker contact in response to the tripping current.

19. The system of claim 17, wherein the electrical system further comprises a facility circuit breaker comprising at least one facility breaker contact, wherein the at least one facility breaker contact connects the at least one trip breaker contact to the electrical power, wherein the enclosure further includes an interlock mechanism having an open and a closed position, wherein the interlock mechanism open position opens the at least one facility breaker contact to disconnect the at least one trip breaker contact from the electrical power, and wherein the interlock mechanism closed position closes the at least one facility breaker contact to connect the at least one trip breaker contact to the electrical power.

* * * * *